US010577724B2

(12) United States Patent
Ohzeki et al.

(10) Patent No.: US 10,577,724 B2
(45) Date of Patent: Mar. 3, 2020

(54) ARC RESISTANT ACRYLIC FIBER, FABRIC FOR ARC-PROTECTIVE CLOTHING, AND ARC PROTECTIVE CLOTHING

(71) Applicant: Kaneka Corporation, Osaka (JP)

(72) Inventors: Tatsuro Ohzeki, Hyogo (JP); Keita Uchibori, Hyogo (JP); Wataru Mio, Hyogo (JP); Yasunori Tanaka, Ishikawa (JP); Yuto Utsunomiya, Ishikawa (JP)

(73) Assignee: KANEKA CORPORATION, Osaka (JP)

( * ) Notice: Subject to any disclaimer, the term of this patent is extended or adjusted under 35 U.S.C. 154(b) by 0 days.

(21) Appl. No.: 15/641,707

(22) Filed: Jul. 5, 2017

(65) Prior Publication Data

US 2017/0295875 A1 Oct. 19, 2017

Related U.S. Application Data

(63) Continuation of application No. PCT/JP2015/084780, filed on Dec. 11, 2015.

(30) Foreign Application Priority Data

Jan. 6, 2015 (JP) ..... 2015-001182
Jul. 7, 2015 (JP) ..... 2015-136426

(51) Int. Cl.

| | |
|---|---|
| ***D01F 6/40*** | (2006.01) |
| ***D03D 1/00*** | (2006.01) |
| ***D03D 15/12*** | (2006.01) |
| ***D01F 6/54*** | (2006.01) |
| ***A41D 31/00*** | (2019.01) |
| ***D01F 1/10*** | (2006.01) |
| ***D06M 15/643*** | (2006.01) |
| ***D06M 11/50*** | (2006.01) |
| ***D06M 15/673*** | (2006.01) |
| ***D06M 11/44*** | (2006.01) |
| ***A41D 31/26*** | (2019.01) |
| ***D06M 11/46*** | (2006.01) |
| ***A41D 13/008*** | (2006.01) |
| *D06M 101/28* | (2006.01) |
| *D06M 101/06* | (2006.01) |

(52) U.S. Cl.

CPC ..... *D01F 6/40* (2013.01); *A41D 13/008* (2013.01); *A41D 31/00* (2013.01); *A41D 31/265* (2019.02); *D01F 1/10* (2013.01); *D01F 1/106* (2013.01); *D01F 6/54* (2013.01); *D03D 1/00* (2013.01); *D03D 15/12* (2013.01); *D06M 11/44* (2013.01); *D06M 11/46* (2013.01); *D06M 11/50* (2013.01); *D06M 15/643* (2013.01); *D06M 15/673* (2013.01); *D06M 2101/06* (2013.01); *D06M 2101/28* (2013.01); *D06M 2200/30* (2013.01)

(58) Field of Classification Search

CPC .. A41D 13/008; A41D 31/00; A41D 31/0072; D01F 1/10; D01F 1/106; D01F 6/40; D01F 6/54; D03D 15/12; D03D 1/00; D06M 11/46; D06M 13/282

See application file for complete search history.

(56) References Cited

U.S. PATENT DOCUMENTS

| | | | | |
|---|---|---|---|---|
| 8,003,555 | B2 * | 8/2011 | Tanaka | D01D 10/02 428/296.7 |
| 2005/0208855 | A1 | 9/2005 | Zhu | |
| 2006/0292953 | A1 | 12/2006 | Ashley et al. | |
| 2009/0282601 | A1 * | 11/2009 | Zhu | A62B 17/003 2/81 |
| 2010/0009186 | A1 | 1/2010 | Zhu | |
| 2010/0029156 | A1 | 2/2010 | Tanaka et al. | |
| 2010/0299817 | A1 | 12/2010 | Zhu | |
| 2011/0281097 | A1 | 11/2011 | Li et al. | |
| 2013/0196135 | A1 | 8/2013 | Li et al. | |
| 2013/0247287 | A1 | 9/2013 | Mizobuchi et al. | |
| 2015/0315725 | A1 * | 11/2015 | Uehata | D01F 6/74 428/221 |
| 2016/0201236 | A1 * | 7/2016 | Matsumoto | D03D 15/12 2/243.1 |
| 2018/0371647 | A1 * | 12/2018 | Sato | D03D 15/00 |

FOREIGN PATENT DOCUMENTS

| | | | |
|---|---|---|---|
| CN | 102409422 | A | 4/2012 |
| CN | 103436974 | A | 12/2013 |
| EP | 2650415 | A1 | 10/2013 |
| JP | S57-106716 | A | 7/1982 |
| JP | S59-039549 | B | 9/1984 |
| JP | H07-324220 | A | 12/1995 |
| JP | 2007-529649 | A | 10/2007 |
| JP | 2007270390 | A | 10/2007 |
| JP | 2012-528954 | A | 11/2012 |
| JP | 2013-147785 | A | 8/2013 |
| WO | 2005090660 | A1 | 9/2005 |

(Continued)

OTHER PUBLICATIONS

International Search Report issued in International Application No. PCT/JP2015/084780 dated Mar. 15, 2016 (9 pages).

Supplementary Partial European Search Report issued in application No. 15876989.3; dated May 18, 2018 (11 pages).

(Continued)

*Primary Examiner* — Arti Singh-Pandey

(74) *Attorney, Agent, or Firm* — Osha Liang LLP

(57) ABSTRACT

An arc resistant acrylic fiber includes an acrylic polymer. The arc resistant acrylic fiber also includes an infrared absorber in an amount of 1 wt % to 30 wt % with respect to a total weight of the acrylic polymer.

14 Claims, 7 Drawing Sheets

(56) References Cited

FOREIGN PATENT DOCUMENTS

| | | | |
|---|---|---|---|
| WO | 2010-010815 | A1 | 1/2010 |
| WO | 2010141554 | A1 | 12/2010 |
| WO | 2012077681 | A1 | 6/2012 |

OTHER PUBLICATIONS

Extended European Search Report issued in European Application No. 15876989.3, dated Aug. 6, 2018 (11 pages).

"Encyclopedia of Chinese Chemical Products vol. 1," Chemical Industry Press, 3rd edition, p. 1329, Jan. 2005 (2 pages).

Office Action issued in corresponding Chinese Application No. 201580072564.9; dated Jul. 30, 2019 (17 pages).

* cited by examiner

ARC RESISTANT ACRYLIC FIBER, FABRIC FOR ARC-PROTECTIVE CLOTHING, AND ARC PROTECTIVE CLOTHING

TECHNICAL FIELD

One or more embodiments of the present invention relate to an arc resistant acrylic fiber having arc resistance, a fabric for arc-protective clothing, and arc-protective clothing.

BACKGROUND

In recent years, a large number of arc flash accidents have been reported, and therefore, in order to reduce the risk of arc flash, the impartment of arc resistance to protective clothing to be worn by workers such as electric mechanics and factory workers who work in an environment that involves the risk of actually being exposed to an electric arc has been studied.

For example, Patent Documents 1 and 2 disclose protective clothing made of arc-protective yarns or fabrics including a modacrylic fiber and an aramid fiber. Patent Document 3 discloses the use of yarns or fabrics including an antimony-containing modacrylic fiber or a flame-retardant acrylic fiber, and an aramid fiber in arc-protective clothing.

CITATION LIST

Patent Documents

Patent Document 1: JP 2007-529649A

Patent Document 2: JP 2012-528954A

Patent Document 3: U.S. Patent Application Publication No. 2006/0292953

However, in Patent Documents 1 and 3, arc resistance is imparted to yarns and fabrics by adjusting the blend amounts of the modacrylic fiber and the aramid fiber, and an improvement in arc resistance of the modacrylic fiber was not studied. In Patent Document 2, the modacrylic fiber containing a reduced amount of antimony and the aramid fiber are blended to produce a blended product to which arc resistance is imparted, and an improvement in arc resistance of the modacrylic fiber was not studied.

SUMMARY

One or more embodiments of the present invention provide an arc resistant acrylic fiber having arc resistance, a fabric for arc-protective clothing, and arc-protective clothing.

One or more embodiments of the present invention relate to an arc resistant acrylic fiber comprising an acrylic polymer that comprises an infrared absorber in an amount of 1 wt % or more and 30 wt % or less with respect to a total weight of the acrylic polymer.

One or more embodiments of the present invention also relate to a fabric for arc-protective clothing that comprises the arc resistant acrylic fiber, wherein a content of the infrared absorber with respect to a total weight of the fabric is 0.5 wt % or more.

In one or more embodiments, the infrared absorber is preferably a tin oxide-based compound, and more preferably one or more selected from the group consisting of antimony-doped tin oxide, indium-tin oxide, niobium-doped tin oxide, phosphorus-doped tin oxide, fluorine-doped tin oxide, and antimony-doped tin oxide coating on titanium dioxide.

In one or more embodiments, it is preferable that the arc resistant acrylic fiber further comprises an ultraviolet absorber. It is more preferable that the ultraviolet absorber is titanium oxide.

In one or more embodiments, it is preferable that the acrylic polymer comprises acrylonitrile in an amount of 40 to 70 wt % and another component in an amount of 30 to 60 wt %, with respect to a total weight of the acrylic polymer.

In one or more embodiments, it is preferable that the fabric for arc-protective clothing further comprises an aramid fiber. It is preferable that the fabric for arc-protective clothing further comprises a cellulosic fiber.

In one or more embodiments, it is preferable that, when the fabric for arc-protective clothing has a basis weight of 8 oz/yd$^2$ or less, an ATPV value measured based on ASTM F1959/F1959M-12 (Standard Test Method for Determining the Arc Rating of Materials for Clothing) is 8 cal/cm$^2$ or more.

In one or more embodiments, it is preferable that the average total reflectivity of the fabric for arc-protective clothing with respect to incident light with a wavelength of 750 to 2500 nm is 50% or less.

One or more embodiments of the present invention also relate to a fabric for arc-protective clothing comprising a cellulosic fiber, the fabric further comprises an infrared absorber and a flame retardant, wherein an average total reflectivity with respect to incident light with a wavelength of 750 to 2500 nm is 60% or less.

One or more embodiments of the present invention also relate to an arc-protective clothing including the fabric for arc-protective clothing.

One or more embodiments of the present invention can provide an arc resistant acrylic fiber having arc resistance, obtained by using an acrylic fiber comprising an infrared absorber. Also, a fabric for arc-protective clothing having arc resistance, obtained by using a fabric comprising acrylic fibers and an infrared absorber, and arc-protective clothing comprising the fabric for arc-protective clothing can be provided. Also, one or more embodiments of the present invention can provide a fabric for arc-protective clothing having arc resistance, obtained by using a fabric comprising cellulosic fibers as well as an infrared absorber and a flame retardant, and setting the average total reflectivity with respect to incident light with a wavelength of 750 to 2500 nm to 60% or less, and arc-protective clothing comprising the fabric for arc-protective clothing.

DESCRIPTION OF EMBODIMENTS

Figure 1A:
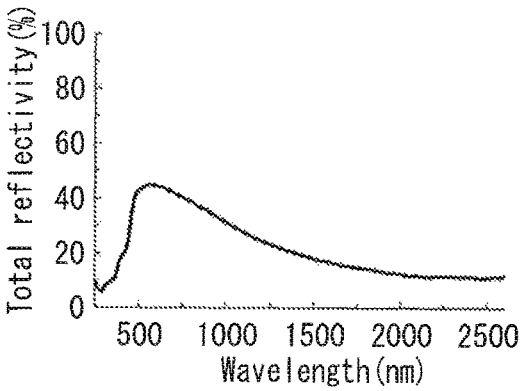
FIG. 1A-FIG. 1G show graphs of total reflectivity of fabrics of examples in a wavelength range of 250 to 2500 nm.
Figure 1B:
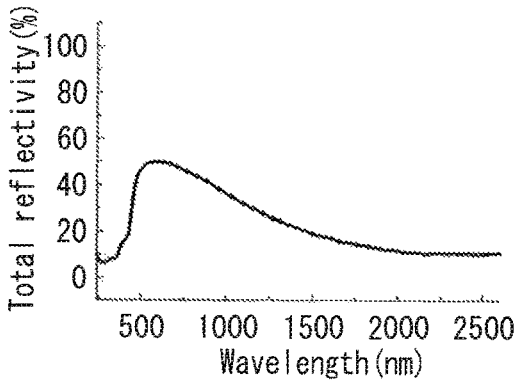
Figure 1C:
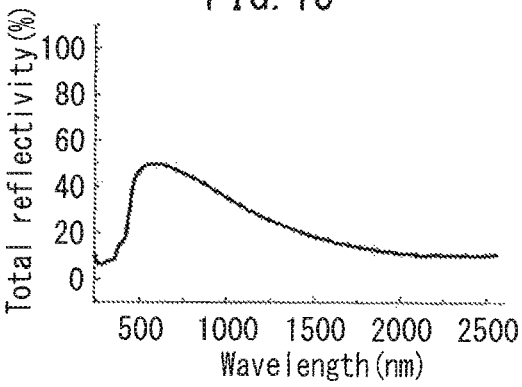
Figure 1D:
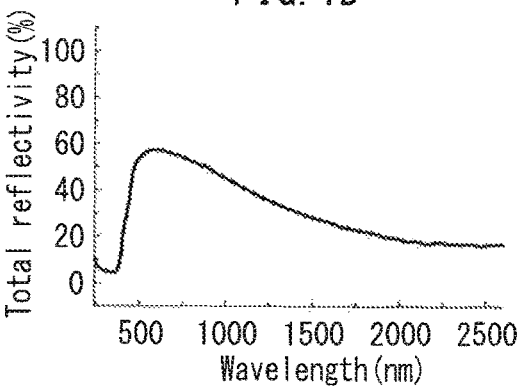
Figure 1E:
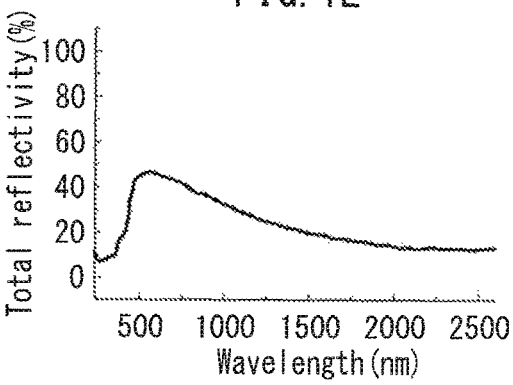
Figure 1F:
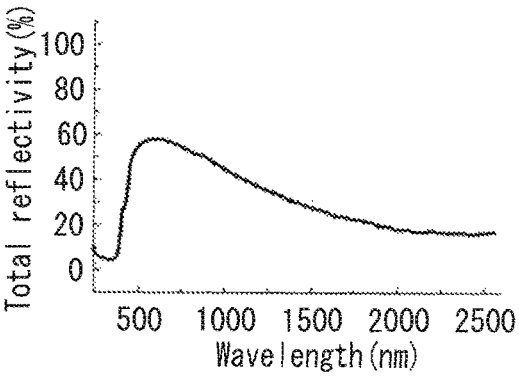
Figure 1G:
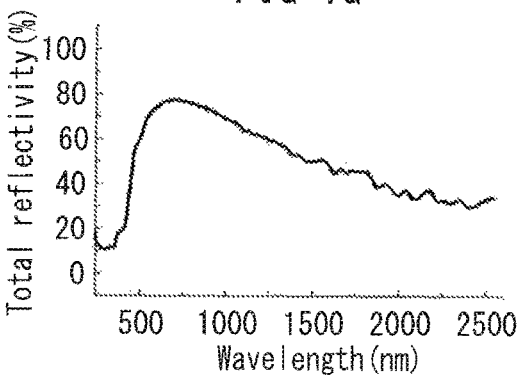
Figure 2A:
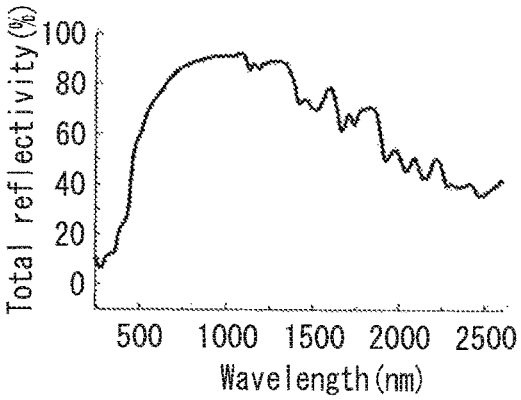
FIG. 2A-FIG. 2G show graphs of total reflectivity of fabrics of comparative examples in a wavelength range of 250 to 2500 nm.
Figure 2B:
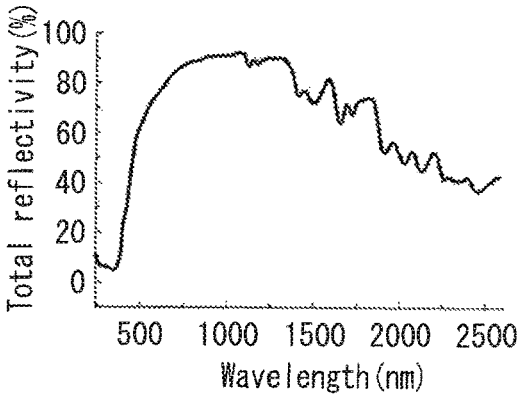
Figure 2C:
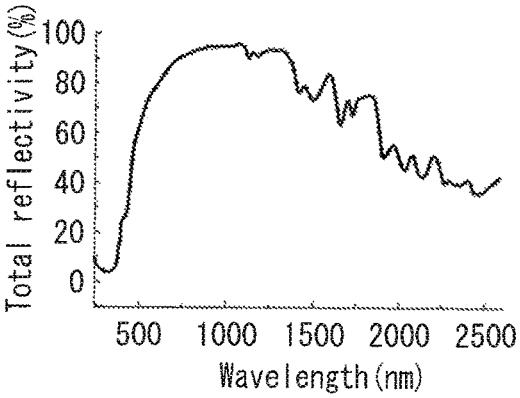
Figure 2D:
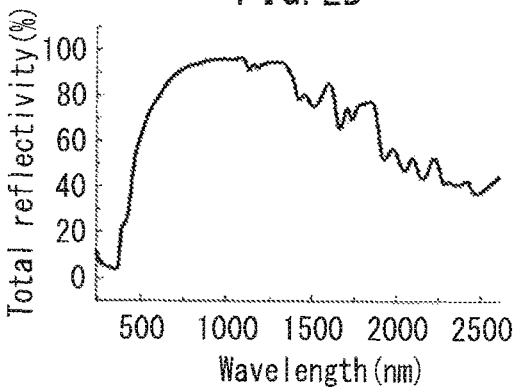
Figure 2E:
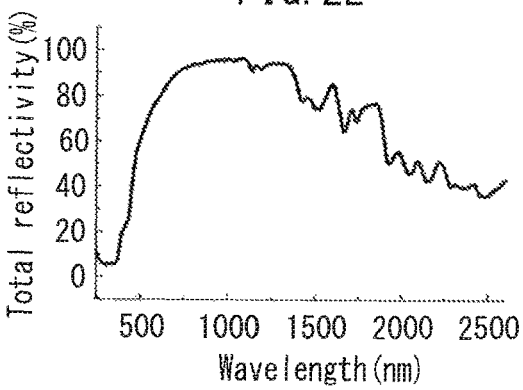
Figure 2F:
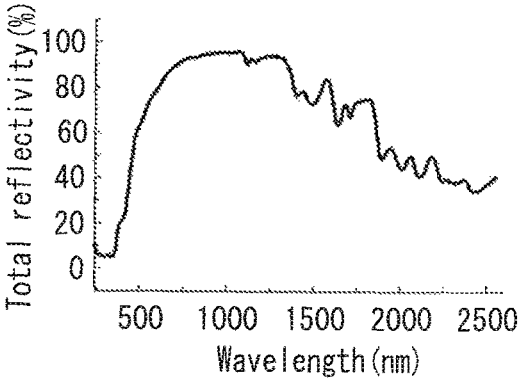
Figure 2G:
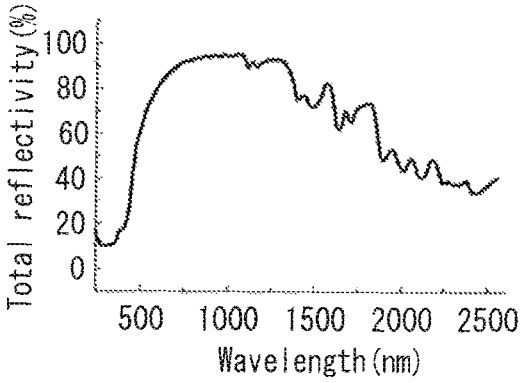
Figure 3A:
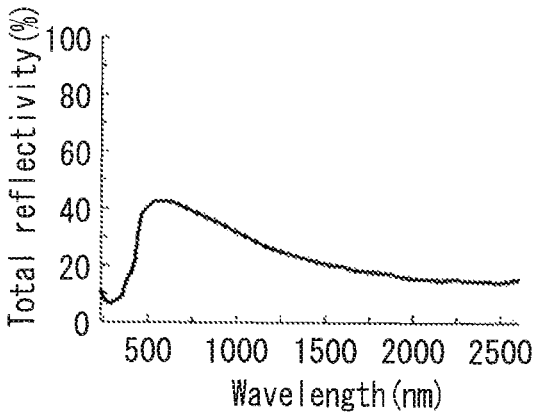
FIG. 3A-FIG. 3F show graphs of total reflectivity of fabrics of examples in a wavelength range of 250 to 2500 nm.
Figure 3B:
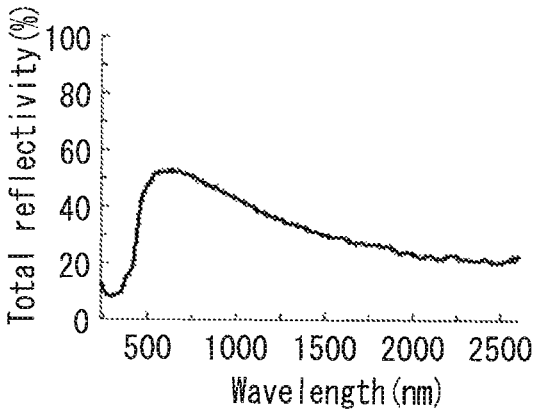
Figure 3C:
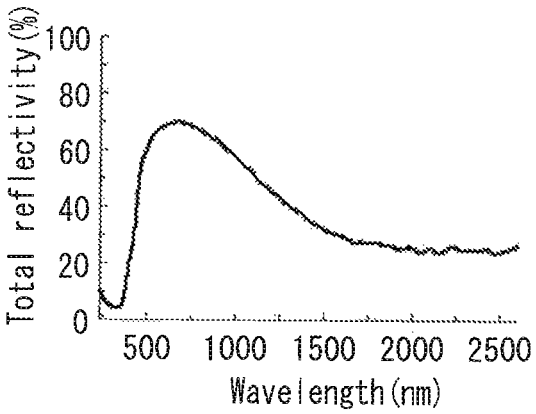
Figure 3D:
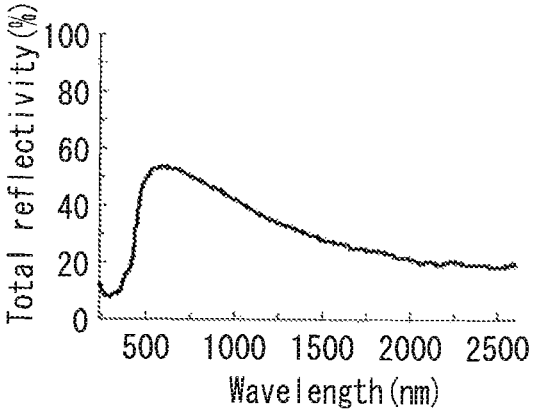
Figure 3E:
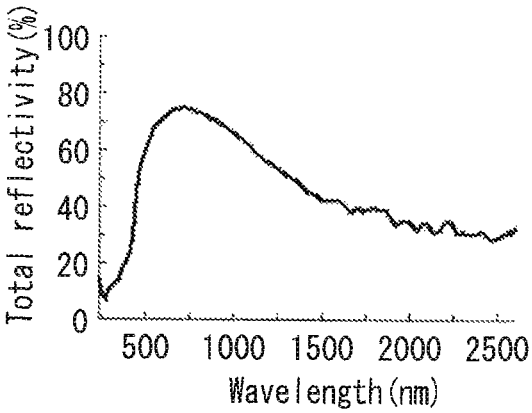
Figure 3F:
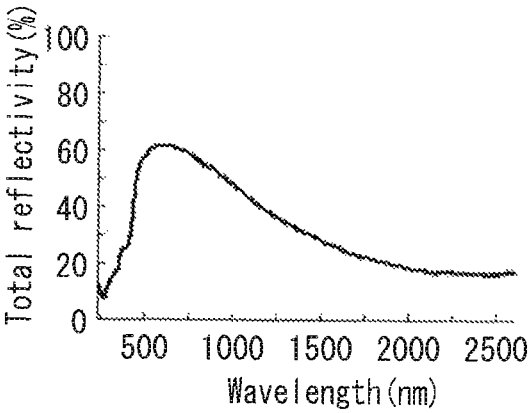
Figure 4A:
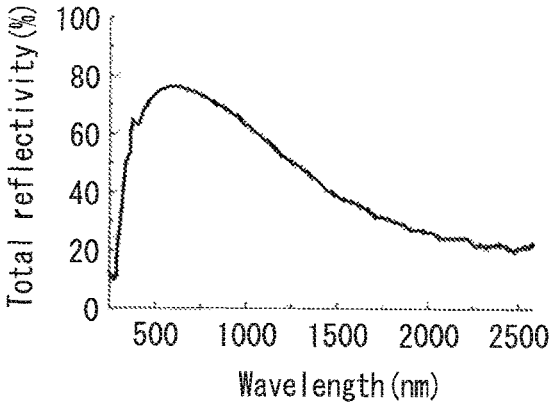
FIG. 4A-FIG. 4D show graphs of total reflectivity of fabrics of examples in a wavelength range of 250 to 2500 nm.
Figure 4C:
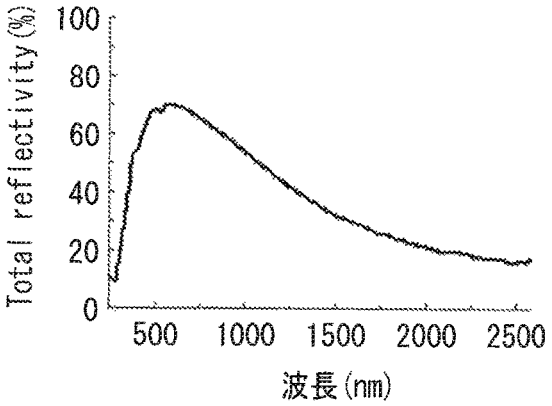
Figure 4B:
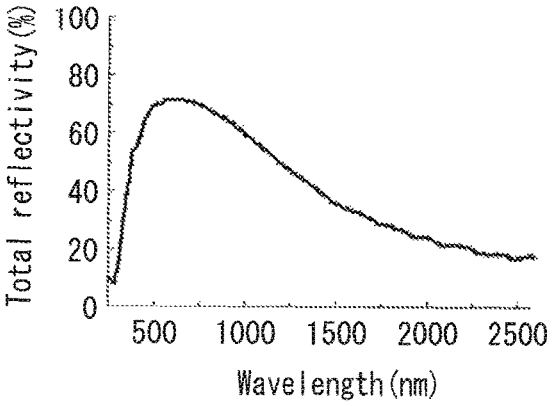
Figure 4D:
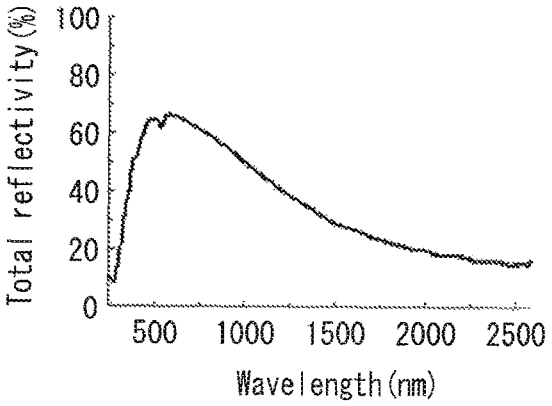

As a result of intensive research on the impartment of arc resistance to a fiber or a fabric, the inventors have found that when an acrylic fiber comprised an infrared absorber and light reflection and/or light absorption thereof was adjusted, an arc property could be imparted to the acrylic fiber, thus making it possible to use the acrylic fiber as an arc resistant fiber. In general, when a fiber comprises an infrared absorber, a heat retaining property is imparted to the fiber due to infrared rays, which are heat rays, being absorbed. However, it was found that when an acrylic fiber or a fabric comprising an acrylic fiber comprised an infrared absorber, the acrylic fiber or the fabric comprising an acrylic fiber exhibited high arc resistance due to light in the infrared region being absorbed. Moreover, it was found that when a fabric comprising a cellulosic fiber comprised an infrared absorber and a flame retardant, and the average total reflectivity of the fabric with respect to incident light with a wavelength of 750 to 2500 nm was set to 60% or less, an arc property could be imparted to the fabric, thus making it possible to use the fabric as an arc resistant fabric.

Arc Resistant Acrylic Fiber

The arc resistant acrylic fiber comprises an infrared absorber. The infrared absorber may exist inside the fiber or may adhere to the surface of the fiber. In one or more embodiments, it is preferable that the infrared absorber exists inside the fiber in terms of texture and washing resistance. The arc resistant acrylic fiber comprises the infrared absorber in an amount of 1 to 30 wt % with respect to the total weight of an acrylic polymer. When the content of the infrared absorber is 1 wt % or more, the acrylic fiber has high arc resistance. When the content of the infrared absorber is 30 wt % or less, favorable texture is achieved. In one or more embodiments, the arc resistant acrylic fiber comprises the infrared absorber preferably in an amount of 2 wt % or more, more preferably in an amount of 3 wt % or more, and even more preferably in an amount of 5 wt % or more, with respect to the total weight of the acrylic polymer in terms of an improvement in arc resistance. In one or more embodiments, the arc resistant acrylic fiber comprises the infrared absorber preferably in an amount of 28 wt % or less, more preferably in an amount of 26 wt % or less, and even more preferably in an amount of 25 wt % or less, with respect to the total weight of the acrylic polymer in terms of texture.

There is no particular limitation on the infrared absorber as long as it has the effect of absorbing infrared rays. Examples of the infrared absorber include antimony-doped tin oxide, indium-tin oxide, niobium-doped tin oxide, phosphorus-doped tin oxide, fluorine-doped tin oxide, antimony-doped tin oxide coating on titanium dioxide, iron-doped titanium oxide, carbon-doped titanium oxide, fluorine-doped titanium oxide, nitrogen-doped titanium oxide, aluminum-doped zinc oxide, and antimony-doped zinc oxide. The indium-tin oxide includes an indium-doped tin oxide and tin-doped indium oxide. In terms of an improvement in arc resistance, the infrared absorber according to one or more embodiments of the present invention is preferably a tin oxide-based compound, more preferably one or more selected from the group consisting of antimony-doped tin oxide, indium-tin oxide, niobium-doped tin oxide, phosphorus-doped tin oxide, fluorine-doped tin oxide, and antimony-doped tin oxide coating on titanium dioxide, even more preferably one or more selected from the group consisting of antimony-doped tin oxide and antimony-doped tin oxide coating on titanium dioxide, and even more preferably antimony-doped tin oxide coating on titanium dioxide. The infrared absorbers may be used alone or in combination of two or more.

In one or more embodiments, the particle diameter of the infrared absorber is preferably 2 μm or less, more preferably 1 μm or less, and even more preferably 0.5 μm or less, in terms of dispersibility in the acrylic polymer constituting the acrylic fiber. When the particle diameter of the infrared absorber is within the above-described range, favorable dispersibility is achieved even when the infrared absorber adheres to the fiber surface of the acrylic fiber. In one or more embodiments of the present invention, the particle diameter of the infrared absorber in powder form can be measured using a laser diffraction method, and the particle diameter of the infrared absorber in dispersion form (dispersion liquid form) formed by dispersing the infrared absorber in water or an organic solvent can be measured using a laser diffraction method or a dynamic light scattering method.

In one or more embodiments, it is preferable that the arc resistant acrylic fiber further comprises an ultraviolet absorber. When light in an ultraviolet region in addition to light in an infrared region is absorbed, the arc resistance is further improved. There is no particular limitation on the ultraviolet absorber, and examples thereof include inorganic compounds such as titanium oxide and zinc oxide, and organic compounds such as triazine-based compounds, benzophenone-based compounds, and benzotriazole-based compounds. In one or more embodiments, out of these compounds, titanium oxide is preferable in terms of coloration degree. In one or more embodiments, the arc resistant acrylic fiber comprises the ultraviolet absorber preferably in an amount of 0.3 to 10 wt %, more preferably in an amount of 0.5 to 7 wt %, and even more preferably in an amount of 1 to 5 wt %, with respect to the total weight of the acrylic polymer. This makes it possible to improve the arc resistance and achieve a favorable texture.

In one or more embodiments, the particle diameter of the ultraviolet absorber is preferably 2 μm or less, more preferably 1.5 μm or less, and even more preferably 1 μm or less, in terms of dispersibility in the acrylic polymer constituting the acrylic fiber. When the particle diameter of the ultraviolet absorber is within the above-described range, favorable dispersibility is achieved, even when the ultraviolet absorber adheres to the fiber surface of the acrylic fiber. In one or more embodiments, when titanium oxide is used, the particle diameter is preferably 0.4 μm or less, and more preferably 0.2 μm or less. There is no limitation on the particle diameter of compounds to be used as the organic ultraviolet absorber and can dissolve in an organic solvent to be used in the production of a spinning dope. In one or more embodiments of the present invention, the particle diameter of the ultraviolet absorber in powder form can be measured using a laser diffraction method, and the particle diameter of the ultraviolet absorber in dispersion form formed by dispersing the ultraviolet absorber in water or an organic solvent can be measured using a laser diffraction method or a dynamic light scattering method.

In one or more embodiments, it is preferable that the arc resistant acrylic fiber is constituted by an acrylic polymer comprising acrylonitrile in an amount of 40 to 70 wt % and another component in an amount of 30 to 60 wt % with respect to the total weight of the acrylic polymer. When the content of acrylonitrile in the acrylic polymer is 40 to 70 wt %, the acrylic fiber has favorable thermal resistance and flame retardance.

There is no particular limitation on the other component as long as it is copolymerizable with acrylonitrile. Examples thereof include halogen-containing vinyl-based monomers and sulfonic group-containing monomers.

Examples of the halogen-containing vinyl-based monomers include halogen-containing vinyl and halogen-containing vinylidene. Examples of the halogen-containing vinyl include vinyl chloride and vinyl bromide, and examples of the halogen-containing vinylidene include vinylidene chloride and vinylidene bromide. These halogen-containing vinyl-based monomers may be used alone or in combination of two or more. In one or more embodiments, it is preferable that the arc resistant acrylic fiber comprises the halogen-containing vinyl-based monomer as the other component in an amount of 30 to 60 wt % with respect to the total weight of the acrylic polymer in terms of thermal resistance and flame retardance.

Examples of the sulfonic group-containing monomers include methacrylicsulfonic acid, allylsulfonic acid, styrenesulfonic acid, 2-acrylamide-2-methylpropanesulfonic acid, and salts thereof. Examples of the salts include sodium salts such as sodium p-styrenesulfonate, potassium salts, and ammonium salts, but there is no limitation thereto. These sulfonic group-containing monomers may be used alone or in combination of two or more. The sulfonic group-containing monomer is used as needed. When the content of the sulfonic group-containing monomer in the acrylic polymer is 3 wt % or less, the production stability of a spinning process is excellent.

In one or more embodiments, it is preferable that the acrylic polymer is a copolymer obtained by copolymerizing acrylonitrile in an amount of 40 to 70 wt %, the halogen-containing vinyl-based monomer in an amount of 30 to 57 wt %, and the sulfonic group-containing monomer in an amount of 0 to 3 wt %. In one or more embodiments, it is more preferable that the acrylic polymer is a copolymer obtained by copolymerizing acrylonitrile in an amount of 45 to 65 wt %, the halogen-containing vinyl-based monomer in an amount of 35 to 52 wt %, and the sulfonic group-containing monomer in an amount of 0 to 3 wt %.

The arc resistant acrylic fiber may comprise an antimony compound. In one or more embodiments, the content of the antimony compound in the acrylic fiber is preferably 1.6 to 33 wt %, and more preferably 3.8 to 21 wt %, with respect to the total weight of the fiber. When the content of the antimony compound in the acrylic fiber is within the above range, the production stability of a spinning process is excellent, and favorable flame resistance is achieved.

Examples of the antimony compound include antimony trioxide, antimony tetroxide, antimony pentoxide, antimonic acid, antimonic acid salts such as sodium antimonate, and antimony oxychloride. These compounds can be used alone or in combination of two or more. In one or more embodiments, it is preferable that the antimony compound is one or more compounds selected from the group consisting of antimony trioxide, antimony tetroxide, and antimony pentoxide in terms of the production stability of a spinning process.

There is no particular limitation on the fineness of the arc resistant acrylic fiber, but the fineness thereof is preferably 1 to 20 dtex, and more preferably 1.5 to 15 dtex, in terms of the texture and strength of a fabric made of the fibers. Also, there is no particular limitation on the fiber length of the acrylic fiber, but the fiber length thereof is preferably 38 to 127 mm, and more preferably 38 to 76 mm, in terms of strength. In one or more embodiments of the present invention, the fineness of the fiber is measured based on JIS L 1015.

There is no particular limitation on the strength of the arc resistant acrylic fiber, but the strength thereof is preferably 1.0 to 4.0 cN/dtex, and more preferably 1.5 to 3.0 cN/dtex, in terms of spinnability and processability. Also, there is no particular limitation on the elongation of the arc resistant acrylic fiber, but the elongation thereof is preferably 20 to 35%, and more preferably 20 to 25%, in terms of spinnability and processability. In one or more embodiments of the present invention, the strength and elongation of the fiber is measured based on JIS L 1015.

The arc resistant acrylic fiber can be manufactured through wet spinning in the same manner as in a normal acrylic fiber, except that the infrared absorber, the ultraviolet absorber, and the like are added to the spinning dope. Alternatively, the arc resistant acrylic fiber may be manufactured by immersing the acrylic fiber in an aqueous dispersion of the infrared absorber and the ultraviolet absorber to attach the infrared absorber and the ultraviolet absorber to the acrylic fiber. At this time, a binder to be used in fiber processing may be used.

The arc resistance of the arc resistant acrylic fiber can be evaluated using a relative value thereof against the arc resistance of the aramid fiber. Specifically, the arc resistance of the arc resistant acrylic fiber can be evaluated using a relative value of the specific ATPV of a fabric made of the arc resistant acrylic fibers in an amount of 100 wt % against the specific ATPV of a fabric made of aramid fibers in an amount of 100 wt %. The "specific ATPV ((cal/cm$^2$)/(oz/yd$^2$))" refers to an ATPV (cal/cm$^2$) per unit basis weight (oz/yd$^2$) and is calculated by dividing the ATPV by the basis weight. The ATPV (arc thermal performance value) is measured through arc testing based on ASTM F1959/F1959M-12 (Standard Test Method for Determining the Arc Rating of Materials for Clothing). The type of fabric has an influence on the ATPV, and therefore, it is necessary to use the same type of fabrics to evaluate the ATPV. When the same type of fabrics are not prepared, or a fabric made of the arc resistant acrylic fiber in an amount of 100 wt % is not prepared, the arc resistance of the arc resistant acrylic fiber can be evaluated using a method described later.

Fabric for Arc-Protective Clothing

Hereinafter, a fabric for arc-protective clothing will be described.

A fabric for arc-protective clothing according to one or more embodiments of the present invention comprises the arc resistant acrylic fiber, and the content of the infrared absorber is 0.5 wt % or more with respect to the total weight of the fabric. In one or more embodiments, the content of the infrared absorber is preferably 1 wt % or more, and more preferably 5 wt % or more, with respect to the total weight of the fabric, in terms of arc resistance. In one or more embodiments, it is preferable that the fabric for arc-protective clothing comprises the infrared absorber in an amount of 10 wt % or less with respect to the total weight of the fabric in terms of texture. The same type of infrared absorber as that used in the arc resistant acrylic fiber can be used as the infrared absorber.

In one or more embodiments, the fabric for arc-protective clothing further comprises an ultraviolet absorber preferably in an amount of 0.15 to 5 wt %, more preferably in an amount of 0.75 to 3.5 wt %, and even more preferably 0.5 to 2.5 wt %, with respect to the total weight of the fabric. The same type of ultraviolet absorber as that used in the arc resistant acrylic fiber can be used as the ultraviolet absorber.

In one or more embodiments, it is more preferable that the fabric for arc-protective clothing comprises an aramid fiber in terms of durability. The aramid fiber may be a para-aramid fiber or a meta-aramid fiber. There is no particular limitation on the fineness of the aramid fiber, but the fineness thereof is preferably 1 to 20 dtex, and more preferably 1.5 to 15 dtex, in terms of strength. Also, there is no particular limitation on the fiber length of the aramid fiber, but the fiber length thereof is preferably 38 to 127 mm, and more preferably 38 to 76 mm, in terms of strength.

In one or more embodiments, the fabric for arc-protective clothing comprises the aramid fiber preferably in an amount of 5 to 30 wt %, and more preferably 10 to 20 wt %, with respect to the total weight of the fabric. When the content of the aramid fibers in the fabric for arc-protective clothing is within the above range, the durability of the fabric can be improved.

The fabric for arc-protective clothing may further comprise a cellulosic fiber in terms of texture. There is no particular limitation on the type of the cellulosic fiber, but it is preferable to use a natural cellulosic fiber in terms of durability. Examples of the natural cellulosic fiber include cotton, kabok, linen, ramie, and jute. Also, the natural cellulosic fiber may be a flame-retarded cellulosic fiber obtained by performing flame-retardant treatment using a flame retardant such as phosphorus-based compounds containing N-methylol phosphonate compounds, tetrakishydroxyalkylphosphonium salts and the like on the natural cellulose fiber such as cotton, kapok, linen, ramie, or jute. These natural cellulosic fibers may be used alone or in combination of two or more. In one or more embodiments, the fiber length of the natural cellulosic fiber is preferably 15 to 38 mm, and more preferably 20 to 38 mm, in terms of strength.

In one or more embodiments, the fabric for arc-protective clothing comprises the natural cellulosic fiber preferably in an amount of 30 to 60 wt %, more preferably in an amount of 30 to 50 wt %, and even more preferably in an amount of 35 to 40 wt %, with respect to the total weight of the fabric. When the content of the natural cellulosic fiber in the fabric for arc-protective clothing is within the above range, excellent texture and hygroscopicity can be imparted to the fabric, and the durability of the fabric can be improved.

The fabric for arc-protective clothing may comprise an acrylic fiber ("also referred to as other acrylic fiber" hereinafter) other than the arc resistant acrylic fiber. There is no particular limitation on the type of other acrylic fiber, and all kinds of acrylic fibers not containing an infrared absorber can be used. An acrylic fiber containing an antimony compound such as antimony oxide may be used, or an acrylic fiber not containing an antimony compound may be used, as the other acrylic fiber.

In one or more embodiments, the fabric for arc-protective clothing comprises the acrylic fibers preferably in a total amount of 30 wt % or more, more preferably in a total amount of 35 wt % or more, and even more preferably in a total amount of 40 wt % or more, with respect to the total weight of the fabric, in terms of thermal resistance.

In one or more embodiments, the basis weight (the weight (ounce) of the fabric per unit area (1 square yard)) of the fabric for arc-protective clothing is preferably 3 to 10 oz/yd$^2$, more preferably 4 to 9 oz/yd$^2$, and even more preferably 4 to 8 oz/yd$^2$. When the basis weight is within the above range, protective clothing that is lightweight and has excellent workability can be provided.

In one or more embodiments, when the fabric for arc-protective clothing has a basis weight of 8 oz/yd$^2$ or less, the ATPV value thereof measured based on ASTM F1959/F1959M-12 (Standard Test Method for Determining the Arc Rating of Materials for Clothing) is preferably 8 cal/cm$^2$ or more. This makes it possible to provide protective clothing that is lightweight and has favorable arc resistance. In one or more embodiments, the ATPV per unit basis weight, namely the specific ATPV (cal/cm$^2$)/(oz/yd$^2$), is preferably 1.1 or more, more preferably 1.2 or more, and even more preferably 1.3 or more.

In one or more embodiments, the average total reflectivity of the fabric for arc-protective clothing with respect to incident light with a wavelength of 750 to 2500 nm is preferably 50% or less, more preferably 40% or less, even more preferably 30% or less, and even more preferably 20% or less. When the average total reflectivity with respect to incident light with a wavelength of 750 to 2500 nm is within the above range, the infrared ray absorbability is high, and thus the arc resistance is excellent. In one or more embodiments, the total reflectivity of the fabric for arc-protective clothing in the wavelength range of 2000 nm or longer is preferably 30% or less, more preferably 25% or less, and even more preferably 20% or less, in terms of high infrared ray absorbability and excellent arc resistance. In this manner, in the fabric for arc-protective clothing, a surface that is directly irradiated with arc during arc irradiation is carbonized by absorbing rather than reflecting incident light with a wavelength of 750 to 2500 nm (light in the infrared region), thus making it possible to further reduce transmitted light. In one or more embodiments of the present invention, the total reflectivity of the fabric may be measured on the front surface or the back surface. In the fabric for arc-protective clothing according to one or more embodiments of the present invention, the difference in the average total reflectivity with respect to incident light with a wavelength of 750 to 2500 nm between a case where the front surface is used as a measurement surface in the total reflectivity measurement and a case where the back surface is used as a measurement surface in the total reflectivity measurement is preferably 10% or less, more preferably 5% or less, and even more preferably 0%.

Examples of the form of the fabric for arc-protective clothing include a woven fabric, a knitted fabric, and an unwoven fabric, but there is no limitation thereto. The woven fabric may be a union fabric, and the knitted fabric may be an interknitted fabric.

There is no particular limitation on the thickness of the fabric for arc-protective clothing, but the thickness thereof is preferably 0.3 to 1.5 mm, more preferably 0.4 to 1.3 mm, and even more preferably 0.5 to 1.1 mm, in terms of strength and comfort of a textile to be used in a piece of workwear. The thickness is measured in conformity with JIS L 1096 (2010).

There is no particular limitation on the weave of the woven fabric. Three foundation weave such as a plain weave, a twill weave, and a sateen weave may be applied, and a patterned woven fabric obtained by using a special loom such as a dobby loom or a Jacquard loom may be used. Also, there is no particular limitation on the knitting of the knitted fabric, and any of circular knitting, flat knitting, and warp knitting may be applied. In one or more embodiments, the fabric is preferably a woven fabric, and more preferably a twill woven fabric, in terms of high tear strength and excellent durability.

The fabric for arc-protective clothing may be a fabric made of a fiber mixture that comprises the arc resistant acrylic fiber including the infrared absorber, or a fabric including the acrylic fiber to which the infrared absorber adheres. When the infrared absorber adheres to the fabric including acrylic fiber, the infrared absorber also adheres to the acrylic fiber. For example, the fabric including the acrylic fiber is impregnated with an aqueous dispersion in which the infrared absorber has been dispersed, thus making it possible to attach the infrared absorber to the fabric as well as the acrylic fiber. At this time, a binder to be used in fiber processing may be used.

A fabric for arc-protective clothing according to one or more embodiments of the present invention comprises a cellulosic fiber, an infrared absorber, and a flame retardant, and the average total reflectivity thereof with respect to incident light with a wavelength of 750 to 2500 nm is 60% or less.

There is no particular limitation on the type of the cellulosic fiber, but it is preferable to use a natural cellulosic fiber in terms of durability. Examples of the natural cellulosic fiber include cotton, kapok, linen, ramie, and jute. In one or more embodiments, out of these natural cellulosic fibers, cotton is preferable in terms of excellent durability. These natural cellulosic fibers may be used alone or in combination or two or more.

In one or more embodiments, the fiber length of the natural cellulose fiber is preferably 15 to 38 mm, and more preferably 20 to 38 mm, in terms of strength.

There is no particular limitation on the infrared absorber as long as it has the effect of absorbing infrared rays. Examples of the infrared absorber include antimony-doped tin oxide, indium-tin oxide, niobium-doped tin oxide, phosphorus-doped tin oxide, fluorine-doped tin oxide, antimony-doped tin oxide coating on titanium dioxide, iron-doped titanium oxide, carbon-doped titanium oxide, fluorine-doped titanium oxide, nitrogen-doped titanium oxide, aluminum-doped zinc oxide, and antimony-doped zinc oxide. The indium-tin oxide includes an indium-doped tin oxide and tin-doped indium oxide. In terms of an improvement in arc resistance, the infrared absorber according to one or more embodiments of the present invention is preferably a tin oxide-based compound, more preferably one or more selected from the group consisting of antimony-doped tin oxide, indium-tin oxide, niobium-doped tin oxide, phosphorus-doped tin oxide, fluorine-doped tin oxide, and antimony-doped tin oxide coating on titanium dioxide, even more preferably one or more selected from the group consisting of antimony-doped tin oxide and antimony-doped tin oxide coating on titanium dioxide, and even more preferably antimony-doped tin oxide coating on titanium dioxide. The infrared absorbers may be used alone or in combination of two or more.

In one or more embodiments, the fabric for arc-protective clothing comprises an ultraviolet absorber preferably in an amount of 0.15 to 5 wt %, more preferably in an amount of 0.3 to 3.5 wt %, and even more preferably in an amount of 0.4 to 2.5 wt %, with respect to the total weight of the fabric, in terms of excellent arc resistance. The same type of ultraviolet absorber as that used in the above-described arc resistant acrylic fiber can be used as the ultraviolet absorber.

There is no particular limitation on the type of the flame retardant, but the flame retardant is preferably a phosphorus-based flame retardant, and more preferably a phosphorus-based compound such as an N-methylol phosphonate compound or a tetrakishydroxyalkylphosphonium salt, in terms of an improvement in arc resistance. The N-methylol phosphonate compound is likely to react with a cellulose molecule and bind thereto. Examples of the N-methylol phosphonate compound include N-methyloldimethyphosphonocarboxylic acid amides such as N-methyloldimethylphosphonopropionic acid amide. The tetrakishydroxyalkylphosphonium salt is likely to form an insoluble polymer in the cellulosic fiber. Examples of the tetrakishydroxyalkylphosphonium salt include tetrakishydroxymethylphosphonium chloride (THPC) and tetrakishydroxymethylphosphonium sulfate (THPS).

In one or more embodiments, the fabric for arc-protective clothing comprises the flame retardant preferably in an amount of 5 to 30 wt %, more preferably in an amount of 10 to 28 wt %, and even more preferably in an amount of 12 to 24 wt %, in terms of excellent arc resistance.

In one or more embodiments, the average total reflectivity of the fabric for arc-protective clothing with respect to incident light with a wavelength of 750 to 2500 nm is preferably 55% or less, more preferably 50% or less, even more preferably 45% or less, and even more preferably 40% or less. When the average total reflectivity with respect to incident light with a wavelength of 750 to 2500 nm is within the above range, high infrared ray absorbability and excellent arc resistance can be achieved. In one or more embodiments, the total reflectivity of the fabric for arc-protective clothing in the wavelength range of 2000 nm or longer is preferably 45% or less, more preferably 40% or less, and even more preferably 35% or less, in terms of high infrared ray absorbability and excellent arc resistance. In one or more embodiments of the present invention, the total reflectivity of the fabric may be measured on the front surface or the back surface. In the fabric for arc-protective clothing according to one or more embodiments of the present invention, the difference in the average total reflectivity with respect to incident light with a wavelength of 750 to 2500 nm between a case where the front surface is used as a measurement surface in the total reflectivity measurement and a case where the back surface is used as a measurement surface in the total reflectivity measurement is preferably 10% or less, more preferably 5% or less, and even more preferably 0%.

The fabric for arc-protective clothing may comprise an aramid fiber in terms of durability. The aramid fiber may be a para-aramid fiber or a meta-aramid fiber. There is no particular limitation on the fineness of the aramid fiber, but the fineness thereof is preferably 1 to 20 dtex, and more preferably 1.5 to 15 dtex, in terms of strength. Also, there is no particular limitation on the fiber length of the aramid fiber, but the fiber length thereof is preferably 38 to 127 mm, and more preferably 38 to 76 mm, in terms of strength.

In one or more embodiments, the fabric for arc-protective clothing comprises the aramid fiber preferably in an amount of 5 to 30 wt %, and more preferably 10 to 20 wt %, with respect to the total weight of the fabric. When the content of the aramid fibers in the fabric for arc-protective clothing is within the above range, the durability of the fabric can be improved.

The fabric for arc-protective clothing may comprise another fiber such as a plant fiber including cotton, hemp and the like, an animal fiber including wool, camel hair, goat hair, silk and the like, a regenerated fiber including a viscose rayon fiber, a cupra fiber and the like, a semisynthetic fiber such as an acetate fiber and the like, or a synthetic fiber including a nylon fiber, a polyester fiber, an acrylic fiber and the like as long as the effects are not inhibited. In one or more embodiments, it is preferable that the fabric for arc-protective clothing comprises another fiber in an amount of 40 wt % or less with respect to the total weight of the fabric.

In one or more embodiments, out of these fibers, the plant fiber and the regenerated fiber are preferable because these fibers are easily carbonized.

In one or more embodiments, the basis weight (the weight (ounce) of the fabric per unit area (1 square yard)) of the fabric for arc-protective clothing is preferably 3 to 10 oz/yd$^2$, more preferably 4 to 9 oz/yd$^2$, and even more preferably 4 to 8 oz/yd$^2$. When the basis weight is within the above range, protective clothing that is lightweight and has excellent workability can be provided.

In one or more embodiments, when the fabric for arc-protective clothing has a basis weight of 8 oz/yd$^2$ or less, the ATPV value thereof measured based on ASTM F1959/F1959M-12 (Standard Test Method for Determining the Arc Rating of Materials for Clothing) is preferably 8 cal/cm$^2$ or more. This makes it possible to provide protective clothing that is lightweight and has favorable arc resistance. In one or more embodiments, the ATPV per unit basis weight, namely the specific ATPV (cal/cm$^2$)/(oz/yd$^2$), is preferably 1.1 or more, more preferably 1.2 or more, and even more preferably 1.3 or more.

Examples of the form of the fabric for arc-protective clothing include a woven fabric, a knitted fabric, and an unwoven fabric, but there is no limitation thereto. The woven fabric may be a union fabric, and the knitted fabric may be an interknitted fabric.

There is no particular limitation on the weave of the woven fabric. The three foundation weave such as a plain weave, a twill weave, and a sateen weave may be applied, and a patterned woven fabric obtained by using a special loom such as a dobby loom or a Jacquard loom may be used. Also, there is no particular limitation on the knitting of the knitted fabric, and any of circular knitting, flat knitting, and warp knitting may be applied. In one or more embodiments, the fabric is preferably a woven fabric, and more preferably a twill woven fabric, in terms of high tear strength and excellent durability.

There is no particular limitation on the thickness of the fabric for arc-protective clothing, but the thickness thereof is preferably 0.3 to 1.5 mm, more preferably 0.4 to 1.3 mm, and even more preferably 0.5 to 1.1 mm, in terms of strength and comfort of a textile to be used in a piece of workwear. The thickness is measured in conformity with JIS L 1096 (2010).

The fabric for arc-protective clothing can be manufactured by performing flame-retardant treatment using a flame retardant on a fabric including a cellulosic fiber, and then attaching an infrared absorber to the fabric.

When a phosphorus-based compound such as an N-methylol phosphonate compound or a tetrakishydroxyalkylphosphonium salt is used as the flame retardant, there is no particular limitation on the flame-retardant treatment using the phosphorus-based compound, but it is preferable to use a Pyrovatex finish in terms of binding of the phosphorus-based compound to a cellulose molecule of the natural cellulose fiber, for example. It is sufficient that the Pyrovatex finish is performed in accordance with known general procedures as described in the technical data of Pyrovatex CP manufactured by Huntsman, for example.

Also, there is no particular limitation on the flame-retardant treatment using the phosphorus-based compound, but it is preferable to use an ammonia curing method using a tetrakishydroxymethylphosphonium salt (also referred to as "THP-ammonia cure method" hereinafter) in terms of the fact that the phosphorus-based compound is likely to form an insoluble polymer in the cellulose fiber, for example. It is sufficient that the THP-ammonia cure method is performed in accordance with known general procedures as described in JP S59-39549B and the like, for example.

Next, the flame-retarded fabric including a natural cellulose fiber is impregnated with an aqueous dispersion in which an infrared absorber has been dispersed, thus making it possible to attach the infrared absorber to the fabric. At this time, a binder to be used in fiber processing may be used.

Arc-Protective Clothing

Arc-protective clothing according to one or more embodiments of the present invention can be manufactured using a known method using the fabric for arc-protective clothing. The arc-protective clothing may be single-layer protective clothing in which the fabric for arc-protective clothing is used in a single layer, or multi-layer protective clothing in which the fabric for arc-protective clothing is used in two or more layers. In the case of multi-layer protective clothing, the fabric for arc-protective clothing may be used in all layers or at least one layer. In one or more embodiments, when the fabric for arc-protective clothing is used in at least one layer of the multi-layer protective clothing, it is preferable to use the fabric for arc-protective clothing in the outer layer.

The arc-protective clothing according to one or more embodiments of the present invention has excellent arc resistance as well as favorable flame retardance and workability. Furthermore, even if the arc-protective clothing is washed repeatedly, the arc resistance and flame retardance thereof are maintained.

One or more embodiments of the present invention provide a method of using the above-described acrylic fiber as an arc resistant acrylic fiber. Specifically, use of such an arc resistant acrylic fiber is provided, wherein the arc resistant acrylic fiber comprising an acrylic polymer, and comprises an infrared absorber in an amount of 1 wt % or more and 30 wt % or less with respect to the total weight of the acrylic polymer. Also, a method of using the above-described fabric as a fabric for arc-protective clothing. Specifically, use of such a fabric for arc-protective clothing is provided, wherein the fabric for arc-protective clothing comprises the arc resistant acrylic fiber, and the content of the infrared absorber is 0.5 wt % or more with respect to the total weight of the fabric. Also, use of such a fabric for arc-protective clothing is provided, wherein the fabric for arc-protective clothing comprises a cellulosic fiber, an infrared absorber, and a flame retardant, and the average total reflectivity with respect to incident light with a wavelength of 750 to 2500 nm is 50% or less.

EXAMPLES

Hereinafter, one or more embodiments of the present invention will be described in detail by way of examples. However, the present invention is not limited to the examples. In the following description, "%" and "part" means "wt %" and "part by weight", respectively, unless otherwise stated.

Example 1

An acrylic copolymer consisting of acrylonitrile in an amount of 51 wt %, vinylidene chloride in an amount of 48 wt %, and sodium p-styrenesulfonate in an amount of 1 wt % was dissolved in dimethylformamide such that the resin concentration was 30 wt %. Antimony trioxide ($Sb_2O_3$; "Patx-M" manufactured by Nihon Seiko Co., Ltd.) in an amount of 10 parts by weight and antimony-doped tin oxide (ATO; "SN-100P" manufactured by Ishihara Sangyo Kaisha, Ltd.) in an amount of 10 parts by weight, with respect to the weight of the resin that was 100 parts by weight, were added to the obtained resin solution to form a spinning dope. Regarding the antimony trioxide, a dispersion liquid was used that was prepared in advance by adding the antimony trioxide in an amount of 30 wt % to dimethylformamide and dispersing it uniformly. In the above dispersion liquid of the antimony trioxide, the particle diameter of the antimony trioxide measured using a laser diffraction method was 2 μm or smaller. Regarding the antimony-doped tin oxide, a dispersion liquid was used that was prepared in advance by adding the antimony-doped tin oxide in an amount of 30 wt % to dimethylformamide and dispersing it uniformly. In the dispersion liquid of the antimony-doped tin oxide, the particle diameter of the antimony-doped tin oxide measured using a laser diffraction method was 0.01 to 0.03 μm. The obtained spinning dope was extruded into a 50 wt % aqueous solution of dimethylformamide using a nozzle with 300 holes having a nozzle hole diameter of 0.08 mm and thus solidified. Thereafter, the solidified product was washed with water and then dried at 120° C. After drying, the product was drawn so as to be longer by a factor of three and then further subjected to heat treatment at 145° C. for 5 minutes. An acrylic fiber was thus obtained. The obtained acrylic fiber of Example 1 (also referred to as "Arc1" hereinafter) had a fineness of 1.7 dtex, a strength of 2.5 cN/dtex, an elongation of 26%, and a cut length of 51 mm. The fineness, strength, and elongation of acrylic fibers of the examples and comparative examples were measured based on JIS L 1015.

Example 2

An acrylic fiber was obtained in the same manner as in Example 1, except that antimony-doped tin oxide (ATO; "SN-100P" manufactured by Ishihara Sangyo Kaisha, Ltd.) in an amount of 20 parts by weight with respect to the weight of the resin that was 100 parts by weight was added to the obtained resin solution to form a spinning dope. The obtained acrylic fiber of Example 2 (also referred to as "Arc2" hereinafter) had a fineness of 2.71 dtex, a strength of 1.77 cN/dtex, an elongation of 23.0%, and a cut length of 51 mm.

Example 3

An acrylic fiber was obtained in the same manner as in Example 1, except that antimony-doped tin oxide (ATO; "SN-100P" manufactured by Ishihara Sangyo Kaisha, Ltd.) in an amount of 5 parts by weight with respect to the weight of the resin that was 100 parts by weight was added to the obtained resin solution to form a spinning dope. The obtained acrylic fiber of Example 3 (also referred to as "Arc3" hereinafter) had a fineness of 1.80 dtex, a strength of 2.60 cN/dtex, an elongation of 28.5%, and a cut length of 51 mm.

Example 4

An acrylic fiber was obtained in the same manner as in Example 1, except that antimony-doped tin oxide coating on titanium dioxide ("ET521W" manufactured by Ishihara Sangyo Kaisha, Ltd.) in an amount of 5 parts by weight with respect to the weight of the resin that was 100 parts by weight was added to the obtained resin solution to form a spinning dope. Regarding the antimony-doped tin oxide coating on titanium dioxide, a dispersion liquid was used that was prepared by adding the antimony-doped tin oxide coating on titanium dioxide in an amount of 30 wt % to dimethylformamide and dispersing it uniformly. In the dispersion liquid of the antimony-doped tin oxide coating on titanium dioxide, the particle diameter of the antimony-doped tin oxide measured using a laser diffraction method was 0.2 to 0.3 μm. The obtained acrylic fiber of Example 4 (also referred to as "Arc4" hereinafter) had a fineness of 1.85 dtex, a strength of 2.63 cN/dtex, an elongation of 27.2%, and a cut length of 51 mm.

Example 5

An acrylic fiber was obtained in the same manner as in Example 1, except that antimony-doped tin oxide (ATO; "SN-100 D" manufactured by Ishihara Sangyo Kaisha, Ltd.) in an amount of 10 parts by weight with respect to the weight of the resin that was 100 parts by weight was added to the obtained resin solution to form a spinning dope. Regarding the antimony-doped tin oxide, an aqueous dispersion was used that was prepared by adding the antimony-doped tin oxide in an amount of 30 wt % to water and dispersing it, and the particle diameter measured using a laser diffraction method was 0.085 to 0.120 μm. The obtained acrylic fiber of Example 5 (also referred to as "Arc5" hereinafter) had a fineness of 1.76 dtex, a strength of 2.80 cN/dtex, an elongation of 29.2%, and a cut length of 51 mm.

Example 6

An acrylic fiber was obtained in the same manner as in Example 1, except that antimony-doped tin oxide (ATO; "SN-100P" manufactured by Ishihara Sangyo Kaisha, Ltd.) in an amount of 10 parts by weight with respect to the weight of the resin that was 100 parts by weight was added to the obtained resin solution to form a spinning dope. The obtained acrylic fiber of Example 6 (also referred to as "Arc6" hereinafter) had a fineness of 1.53 dtex, a strength of 2.80 cN/dtex, an elongation of 26.5%, and a cut length of 51 mm.

Example 7

An acrylic fiber was obtained in the same manner as in Example 1, except that antimony-doped tin oxide (ATO; "SN-100P" manufactured by Ishihara Sangyo Kaisha, Ltd.) in an amount of 5 parts by weight and titanium oxide ("R-22L" manufactured by Sakai Chemical Industry Co., Ltd.) in an amount of 10 parts by weight, with respect to the weight of the resin that was 100 parts by weight, were added to the obtained resin solution to form a spinning dope. Regarding the titanium oxide, a dispersion liquid was used that was prepared in advance by adding the titanium oxide in an amount of 30 wt % to dimethylformamide and dispersing it uniformly. In the dispersion liquid of the titanium oxide, the particle diameter of the titanium oxide measured using a laser diffraction method was 0.4 μm. The obtained acrylic fiber of Example 7 (also referred to as "Arc7" hereinafter) had a fineness of 1.75 dtex, a strength of 1.66 cN/dtex, an elongation of 22.9%, and a cut length of 51 mm.

Example 8

An acrylic fiber was obtained in the same manner as in Example 1, except that antimony-doped tin oxide coating on titanium dioxide ("ET521W" manufactured by Ishihara Sangyo Kaisha, Ltd.) in an amount of 20 parts by weight and antimony trioxide ($Sb_2O_3$; "Patx-M" manufactured by Nihon Seiko Co., Ltd.) in an amount of 10 parts by weight, with respect to the weight of the resin that was 100 parts by weight, were added to the obtained resin solution to form a spinning dope. Regarding the antimony-doped tin oxide coating on titanium dioxide, a dispersion liquid was used that was prepared by adding the antimony-doped tin oxide coating on titanium dioxide in an amount of 30 wt % to dimethylformamide and dispersing it uniformly. In the dispersion liquid of the antimony-doped tin oxide coating on titanium dioxide, the particle diameter of the antimony-doped tin oxide measured using a laser diffraction method was 0.2 to 0.3 μm. The obtained acrylic fiber of Example 8 (also referred to as "Arc8" hereinafter) had a fineness of 1.81 dtex, a strength of 2.54 cN/dtex, an elongation of 27.5%, and a cut length of 51 mm.

Example 9

An acrylic fiber was obtained in the same manner as in Example 8, except that an acrylic copolymer consisting of acrylonitrile in an amount of 51 wt %, vinyl chloride in an amount of 48 wt %, and sodium p-styrenesulfonate in an amount of 1 wt % was used instead of the acrylic copolymer consisting of acrylonitrile in an amount of 51 wt %, vinylidene chloride in an amount of 48 wt %, and sodium p-styrenesulfonate in an amount of 1 wt %. The obtained acrylic fiber of Example 9 (also referred to as "Arc9" hereinafter) had a fineness of 1.78 dtex, a strength of 1.97 cN/dtex, an elongation of 33.3%, and a cut length of 51 mm.

Comparative Example 1

An acrylic fiber was obtained in the same manner as in Example 1, except that antimony trioxide ($Sb_2O_3$; "Patx-M" manufactured by Nihon Seiko Co., Ltd.) in an amount of 10 parts by weight with respect to the weight of the resin that was 100 parts by weight was added to the obtained resin solution to form a spinning dope. The obtained acrylic fiber of Comparative Example 1 (also referred to as "Arc101" hereinafter) had a fineness of 1.71 dtex, a strength of 2.58 cN/dtex, an elongation of 27.4%, and a cut length of 51 mm.

Comparative Example 2

An acrylic fiber was obtained in the same manner as in Example 1, except that antimony trioxide ($Sb_2O_3$; "Patx-M" manufactured by Nihon Seiko Co., Ltd.) in an amount of 10 parts by weight and titanium oxide ("R-22L" manufactured by Sakai Chemical Industry Co., Ltd.) in an amount of 10 parts by weight, with respect to the weight of the resin that was 100 parts by weight, were added to the obtained resin solution to form a spinning dope. Regarding the titanium oxide, a dispersion liquid was used that was prepared in advance by adding the titanium oxide in an amount of 30 wt % to dimethylformamide and dispersing it uniformly. In the dispersion liquid of the titanium oxide, the particle diameter of the titanium oxide measured using a laser diffraction method was 0.4 μm. The obtained acrylic fiber of Comparative Example 2 (also referred to as "Arc102" hereinafter) had a fineness of 1.74 dtex, a strength of 2.37 cN/dtex, an elongation of 28.6%, and a cut length of 51 mm.

Comparative Example 3

An acrylic fiber was obtained in the same manner as in Example 1, except that antimony trioxide ($Sb_2O_3$; "Patx-M" manufactured by Nihon Seiko Co., Ltd.) in an amount of 10 parts by weight and titanium oxide ("STR-60A-LP" manufactured by Sakai Chemical Industry Co., Ltd.) in an amount of 10 parts by weight, with respect to the weight of the resin that was 100 parts by weight, were added to the obtained resin solution to form a spinning dope. Regarding the titanium oxide, a dispersion liquid was used that was prepared in advance by adding the titanium oxide in an amount of 30 wt % to dimethylformamide and dispersing it uniformly. In the dispersion liquid of the titanium oxide, the particle diameter of the titanium oxide measured using a laser diffraction method was 0.05 μm. The obtained acrylic fiber of Comparative Example 3 (also referred to as "Arc103" hereinafter) had a fineness of 1.70 dtex, a strength of 2.59 cN/dtex, an elongation of 27.1%, and a cut length of 51 mm.

Comparative Example 4

An acrylic fiber was obtained in the same manner as in Example 1, except that antimony trioxide ($Sb_2O_3$; "Patx-M" manufactured by Nihon Seiko Co., Ltd.) in an amount of 10 parts by weight and zinc oxide ("FINEX-25-LPT" manufactured by Sakai Chemical Industry Co., Ltd.) in an amount of 10 parts by weight, with respect to the weight of the resin that was 100 parts by weight, were added to the obtained resin solution to form a spinning dope. Regarding the zinc oxide, a dispersion liquid was used that was prepared in advance by adding the zinc oxide in an amount of 30 wt % to dimethylformamide and dispersing it uniformly. In the dispersion liquid of the zinc oxide, the particle diameter of the zinc oxide measured using a laser diffraction method was 0.06 μm. The obtained acrylic fiber of Comparative Example 4 (also referred to as "Arc104" hereinafter) had a fineness of 1.83 dtex, a strength of 2.13 cN/dtex, an elongation of 26.2%, and a cut length of 51 mm.

Comparative Example 5

An acrylic fiber was obtained in the same manner as in Example 1, except that antimony trioxide ($Sb_2O_3$; "Patx-M" manufactured by Nihon Seiko Co., Ltd.) in an amount of 10 parts by weight and SB-UVA6164 (triazine-based ultraviolet absorber; manufactured by SHUANG-BANG INDUSTRIAL CORP.) in an amount of 10 parts by weight, with respect to the weight of the resin that was 100 parts by weight, were added to the obtained resin solution to form a spinning dope. Regarding the SB-UVA6164, a solution was used that was prepared in advance by adding the SB-UVA6164 in an amount of 5 wt % to dimethylformamide and dissolving it. The obtained acrylic fiber of Comparative Example 5 (also referred to as "Arc105" hereinafter) had a fineness of 1.71 dtex, a strength of 2.26 cN/dtex, an elongation of 26.9%, and a cut length of 51 mm.

Comparative Example 6

An acrylic fiber was obtained in the same manner as in Example 1, except that antimony trioxide ($Sb_2O_3$; "Patx-M" manufactured by Nihon Seiko Co., Ltd.) in an amount of 10 parts by weight and SB-UVA6577 (triazine-based ultraviolet absorber; manufactured by SHUANG-BANG INDUSTRIAL CORP.) in an amount of 10 parts by weight, with respect to the weight of the resin that was 100 parts by weight, were added to the obtained resin solution to form a spinning dope. Regarding the SB-UVA6577, a solution was used that was prepared in advance by adding the SB- UVA6577 in an amount of 5 wt % to dimethylformamide and dissolving it. The obtained acrylic fiber of Comparative Example 6 (also referred to as "Arc106" hereinafter) had a fineness of 1.77 dtex, a strength of 2.46 cN/dtex, an elongation of 31.2%, and a cut length of 51 mm.

Examples A1 to A12, Comparative Examples A1 to A7

The acrylic fibers of Examples 1 to 9 and Comparative Examples 1 to 6 each were mixed, in blending ratios shown in Table 1 below, with a para-aramid fiber ("Taparan" (registered trademark) manufactured by Yantai Tayho Advanced Materials Co., Ltd.; having a fineness of 1.67 dtex and a fiber length of 51 mm; also referred to as "PA" hereinafter), a meta-aramid fiber ("Tametar" (registered trademark) manufactured by Yantai Tayho Advanced Materials Co., Ltd.; having a fineness of 1.5 dtex and a fiber length of 51 mm; also referred to as "MA" hereinafter), an acrylic fiber ("Protex-C" manufactured by Keneka Corporation, which is made of an acrylic copolymer consisting of acrylonitrile in an amount of 51 wt %, vinylidene chloride in an amount of 48 wt % and sodium p-styrenesulfonate in an amount of 1 wt % and contains antimony trioxide in an amount of 10 wt % with respect to the weight of the resin (acrylic copolymer); having a fineness of 1.7 dtex and a fiber length of 51 mm; also referred to as "ProC" hereinafter), and an acrylic fiber ("PBB" manufactured by Keneka Corporation, which is made of an acrylic copolymer comprising acrylonitrile in an amount of 51 wt %, vinylidene chloride in an amount of 48 wt %, and sodium p-styrenesulfonate in an amount of 1 wt %; having a fineness of 1.7 dtex and a fiber length of 51 mm; also referred to as "PBB" hereinafter), and then were spun through ring spinning. The obtained spun yarns were mixed yarns of English cotton count No. 20. The spun yarns were used to manufacture plain-knitted fabrics having a basis weight shown in Table 1 below using an ordinary manufacturing method with a flat-knitting machine.

Example A13

The acrylic fiber (ProC) in an amount of 50 wt % and the para-aramid fiber (PA) in an amount of 50 wt % were mixed, and then were spun through ring spinning. The obtained spun yarn was a mixed yarn of English cotton count No. 20. The spun yarn was used to manufacture a plain-knitted fabric having a basis weight shown in Table 1 below using an ordinary manufacturing method with a flat-knitting machine. The obtained fabric was impregnated with an antimony-doped tin oxide dispersion ("SN-100D" manufactured by Ishihara Sangyo Kaisha, Ltd., which is an aqueous dispersion obtained by adding antimony-doped tin oxide in an amount of 30 wt % to water and dispersing it; having a particle diameter distribution of 0.085 to 0.120 μm, which was measured using a laser diffraction method) and then dried, and thus the antimony-doped tin oxide in an amount of 2 wt % with respect to the total weight of the fabric was attached to the fabric.

Example A14

First, an acrylic copolymer comprising acrylonitrile in an amount of 51 wt %, vinylidene chloride in an amount of 48 wt %, and sodium p-styrenesulfonate in an amount of 1 wt % was dissolved in dimethylformamide such that the resin concentration was 30 wt %. Antimony trioxide ($Sb_2O_3$; "Patx-M" manufactured by Nihon Seiko Co., Ltd.) in an amount of 26 parts by weight with respect to the weight of the resin that was 100 parts by weight was added to the obtained resin solution to form a spinning dope. The obtained spinning dope was extruded into a 50 wt % aqueous solution of dimethylformamide using a nozzle with 300 holes having a nozzle hole diameter of 0.08 mm and thus solidified. Thereafter, the solidified product was washed with water and then dried at 120° C. After drying, the product was drawn so as to be longer by a factor of three and then further subjected to heat treatment at 145° C. for 5 minutes. An acrylic fiber was thus obtained. The obtained acrylic fiber had a fineness of 2.2 dtex, a strength of 2.33 cN/dtex, an elongation of 22.3%, and a cut length of 51 mm.

Next, the obtained acrylic fiber (also referred to as "ProM" hereinafter) in an amount of 60 wt % and commercially available cotton (middle-fiber cotton; also referred to as "Cot" hereinafter) in an amount of 40 wt % were mixed, and then spun through ring spinning. The obtained spun yarn was a mixed yarn of English cotton count No. 20. The spun yarn was used to manufacture a twill woven fabric (fabric) having a basis weight shown in Table 1 below using an ordinary weaving method. The obtained fabric was impregnated with a dispersion of antimony-doped tin oxide coating on titanium dioxide ("ET521W" manufactured by Ishihara Sangyo Kaisha, Ltd.) (a dispersion obtained by adding antimony-doped tin oxide coating on titanium dioxide in an amount of 30 wt % to dimethylformamide and dispersing it; having a particle diameter of 0.2 to 0.3 μm, which was measured using a laser diffraction method) and then dried, and thus the antimony-doped tin oxide coating on titanium dioxide in an amount of 1.3 wt % with respect to the total weight of the fabric was attached to the fabric.

Example A15

A twill woven fabric (fabric) having a basis weight shown in Table 1 below was manufactured in the same manner as in Example A14. The obtained fabric was impregnated with a methanol dispersion of antimony-doped zinc oxide ("CELNAX CX-Z610M-F2" manufactured by Nissan Chemical Industries, Ltd., which is a methanol dispersion obtained by adding antimony-doped zinc oxide in an amount of 60 wt % to methanol and dispersing it; having an average particle diameter (D50) of 15 nm, which was measured using a laser diffraction method) and then dried, and thus the antimony-doped zinc oxide in an amount of 0.66 wt % with respect to the total weight of the fabric was attached to the fabric.

Example A16

A fabric was manufactured in the same manner as in Example A15, except that antimony-doped zinc oxide in an amount of 1.4 wt % with respect to the total weight of the fabric was attached to the fabric.

Example A17

A fabric was manufactured in the same manner as in Example A15, except that antimony-doped zinc oxide in an amount of 2.1 wt % with respect to the total weight of the fabric was attached to the fabric.

Reference Example 1

The para-aramid fiber (PA) in an amount of 50 wt % and the meta-aramid fiber (MA) in an amount of 50 wt % were mixed, and then were spun through ring spinning. The obtained spun yarn was a mixed yarn of English cotton count No. 20. The spun yarn was used to manufacture a twill woven fabric (fabric) having a basis weight shown in Table 1 below using an ordinary weaving method.

Reference Example 2

The acrylic fiber (ProC) in an amount of 50 wt %, the para-aramid fiber (PA) in an amount of 25 wt %, and the meta-aramid fiber (MA) in an amount of 25 wt % were mixed, and then were spun through ring spinning. The obtained spun yarn was a mixed yarn of English cotton count No. 20. The spun yarn was used to manufacture a twill woven fabric (fabric) having a basis weight shown in Table 1 below using an ordinary weaving method.

Reference Example 3

The acrylic fiber (ProC) in an amount of 50 wt %, the para-aramid fiber (PA) in an amount of 25 wt %, and the meta-aramid fiber (MA) in an amount of 25 wt % were mixed, and then were spun through ring spinning. The obtained spun yarn was a mixed yarn of English cotton count No. 20. The spun yarn was used to manufacture a plain-knitted fabric having a basis weight shown in Table 1 below using an ordinary manufacturing method with a flat-knitting machine.

Figure 5A:
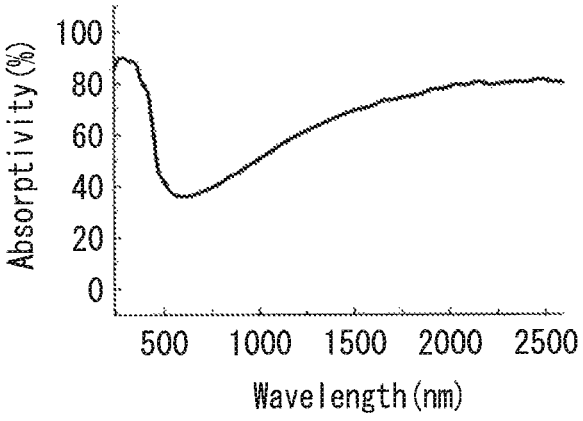
FIG. 5A-FIG. 5C show graphs of absorptivity of fabrics of examples in a wavelength range of 250 to 2500 nm.
Figure 5B:
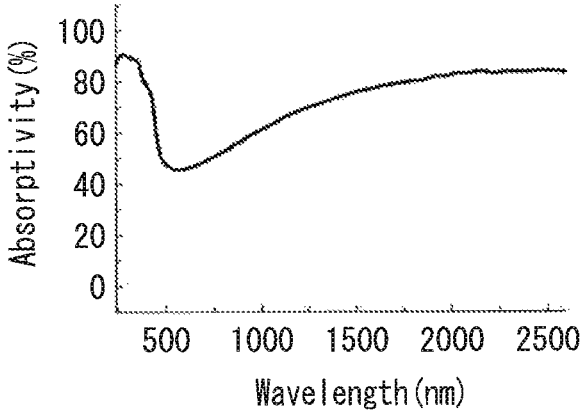
Figure 5C:
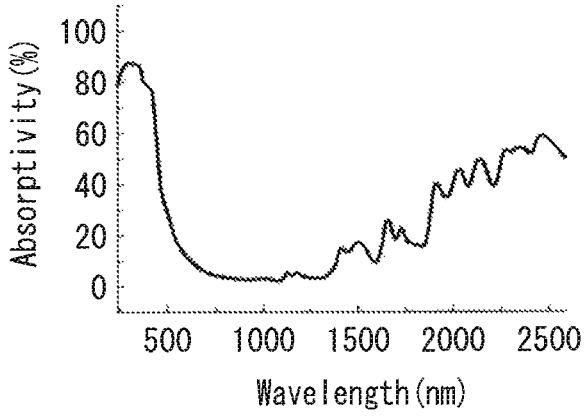
Figure 6A:
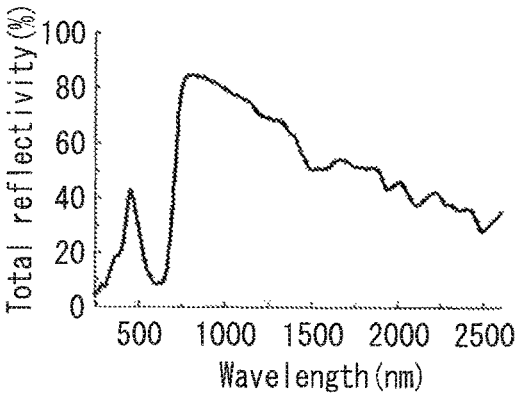
FIG. 6A-FIG. 6G show graphs of total reflectivity of fabrics of examples and a comparative example in a wavelength range of 250 to 2500 nm.
Figure 6B:
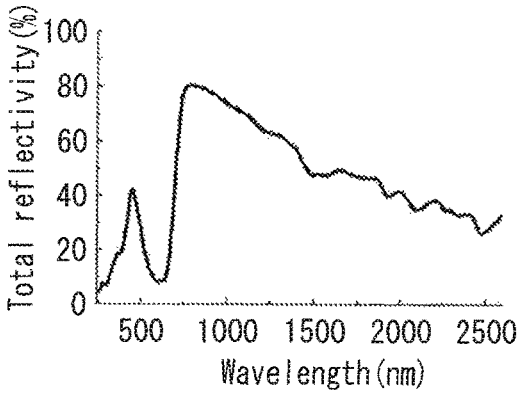
Figure 6C:
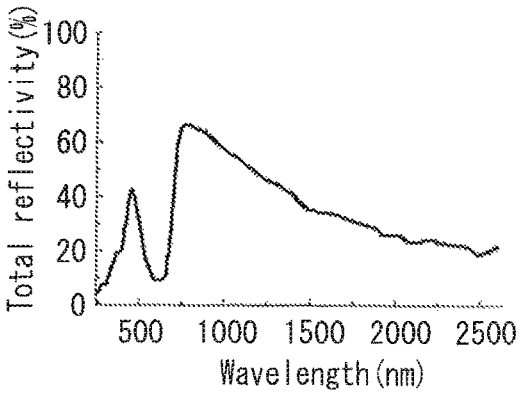
Figure 6D:
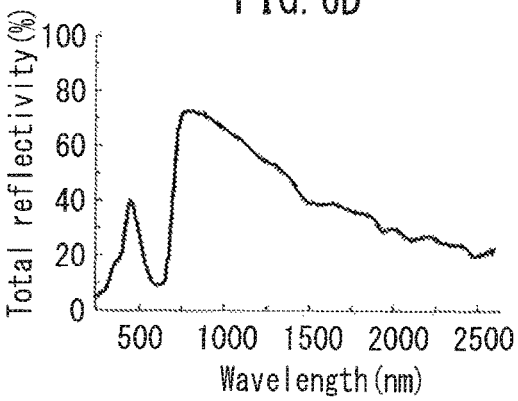
Figure 6E:
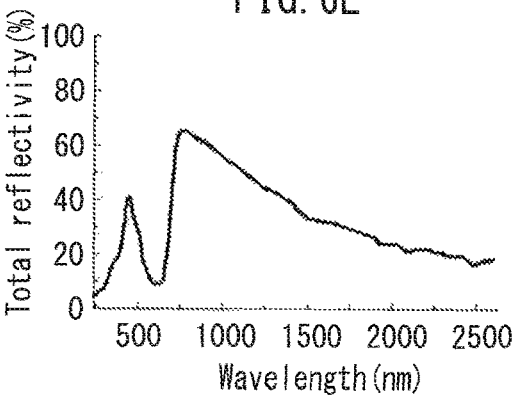
Figure 6F:
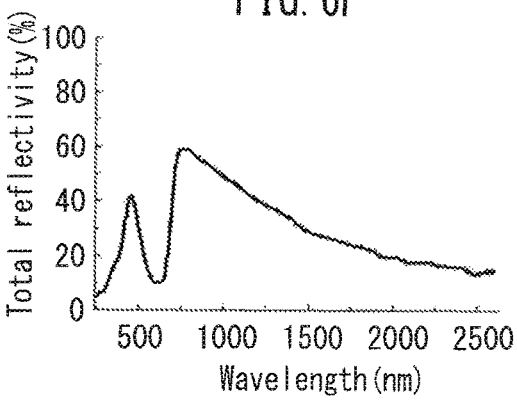
Figure 6G:
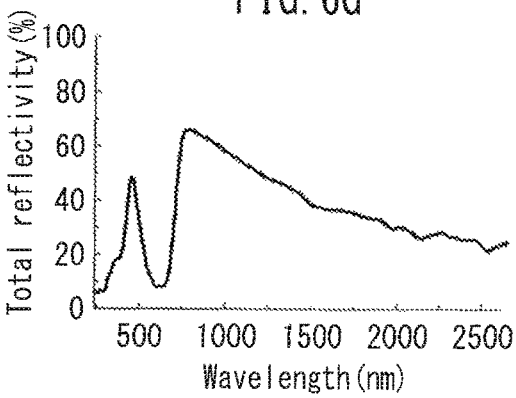

The arc resistance of each of the acrylic fibers of Examples 1 to 9 and Comparative Examples 1 to 6 was evaluated based on the standards below through arc testing performed on the fabrics including the acrylic fibers of Examples A1 to A17 and Comparative Examples A1 to A7. Table 1 below shows the results. The arc resistance of each of the fabrics obtained in Examples A1 to A17 and Comparative Examples A1 to A7 was evaluated through arc testing. Table 1 below shows the results. The thickness of each of the fabrics obtained in Examples A1 to A10 and A14 to 17 and Comparative Examples A1 to A7 was measured as described below. Table 1 below shows the results. It should be noted that the content of an infrared absorber is represented in terms of a weight ratio with respect to the total weight of the fabric in Table 1 below. The total reflectivity of each of the fabrics obtained in Examples A1 to A17 and Comparative Examples A1 to A7 was measured as described below. FIGS. 1, 2, 3, and 4 and Tables 2 and 3 below show the results. In Tables 2 and 3 below, the average total reflectivity refers to an average total reflectivity with respect to incident light with a wavelength of 750 to 2500 nm. The transmittance of each of the fabrics of Examples A4 and A8 and Comparative Example A7 was measured as described below. FIG. 5 and Table 4 show data regarding absorptivity (light absorptivity) calculated based on the total reflectivity and transmittance of each of the fabrics of Examples A4 and A8 and Comparative Example A7. In Table 4 below, the average absorptivity refers to an average absorptivity with respect to incident light with a wavelength of 750 to 2500 nm.

Arc Testing

The arc testing was performed based on ASTM F1959/F1959M-12 (Standard Test Method for Determining the Arc Rating of Materials for Clothing), and thus an ATPV (cal/cm$^2$) was determined.

Specific ATPV

An ATPV per unit basis weight (cal/cm$^2$)/(oz/yd$^2$) of the fabric, namely the specific ATPV, was calculated based on the basis weight of the fabric and the ATPV determined through the arc testing.

Arc Resistance of Acrylic Fiber (1) The specific ATPV of the fabric (woven fabric) of Reference Example 1 was taken as Ref1, the specific ATPV of the fabric (woven fabric) of Reference Example 2 was taken as Ref2, and the specific ATPV of the fabric (knitted fabric) of Reference Example 3 was taken as Ref3. The specific ATPV of a knitted fabric including an aramid fiber in an amount of 100 wt % was calculated based on the following equation.

$$\text{Specific ATPV of knitted fabric including aramid fiber in an amount of 100 wt \%} = \text{Ref1} \times \text{Ref3}/\text{Ref2}$$

(2) Assuming that the arc resistance of the para-aramid fiber and the arc resistance of the meta-aramid fiber are the same, the specific ATPV of the knitted fabric including the aramid fiber in an amount of 100 wt % was taken as the specific ATPV of the aramid fiber, and the specific ATPV of the acrylic fiber in the target fabric was calculated using the specific ATPV of the target fabric based on Equation (I) below.

$$\text{Specific ATPV of acrylic fiber} = (X - Y \times Wa/100)/(Wb/100) \quad \text{(I)}$$

In Equation (I), X is the specific ATPV (cal/cm$^2$)/(oz/yd$^2$) of the target fabric, Y is the specific ATPV of the aramid fiber, Wa is the content (wt %) of the aramid fiber with respect to the total weight of the target fabric, and Wb is the content (wt %) of the acrylic fiber with respect to the total weight of the target fabric.

(3) The specific ATPV of the aramid fiber was taken as 1, and the arc resistance of the acrylic fiber was evaluated using an ATPC calculated based on Equation II below.

$$\text{ATPC of acrylic fiber} = \text{specific ATPV of acrylic fiber}/\text{specific ATPV of aramid fiber} \quad \text{(II)}$$

(4) When the ATPC value of the acrylic fiber was 2.1 or more, it was determined that the arc resistance was acceptable. The higher the ATPC value is, the better the arc resistance is.

It should be noted that when the target fabric comprises another fiber in addition to the acrylic fiber and the aramid fiber, Equation (III) below is used instead of Equation (I) in the item (2) above.

$$\text{Specific ATPV of acrylic fiber (cal/cm}^2\text{)/(oz/yd}^2\text{)} = (X - Y \times Wa/100 - Z \times Wz/100)/(Wb/100) \quad \text{(III)}$$

In Equation (III), X is the specific ATPV of the target fabric, Y is the specific ATPV of the aramid fiber, Z is the specific ATPV of another fiber, Wa is the content (wt %) of the aramid fiber with respect to the total weight of the target fabric, Wb is the content (wt %) of the acrylic fiber with respect to the total weight of the target fabric, and Wz is the content (wt %) of another fiber with respect to the total weight of the target fabric.

Thickness

The thickness was measured in conformity with JIS L 1096 (2010).

Figure 7:
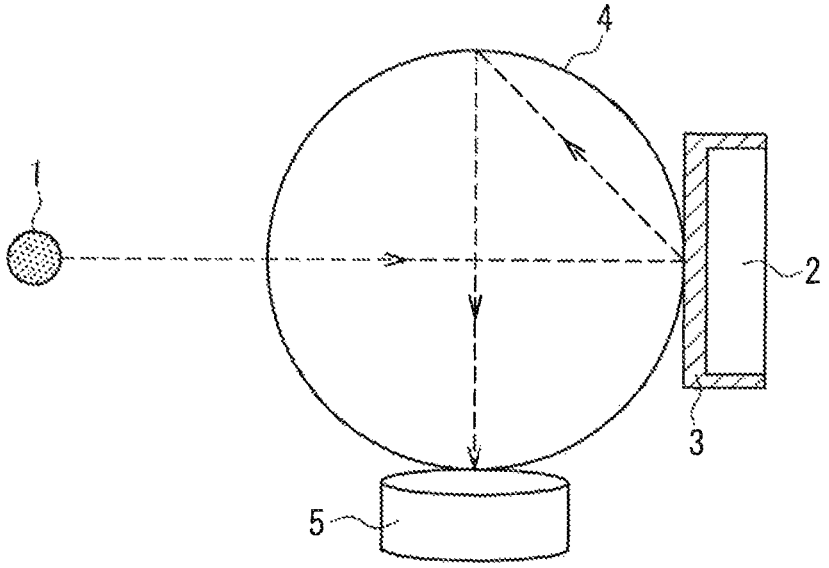
FIG. 7 is a schematic explanatory diagram illustrating a measurement method of measuring a total reflectivity of a fabric with respect to incident light.

Total Reflectivity and Transmittance (1) First, a spectrophotometer (model "U-4100" manufactured by Hitachi High-Technologies Corporation) was used to measure the total reflectivity of the fabric. Specifically, as shown in FIG. 7, light emitted by a xenon lamp 1 was dispersed, the front surface of a fabric 3 with an alumina plate 2 being placed on its back surface was irradiated with the dispersed light, reflected light was integrated using an integrating sphere 4, the light intensity was measured using a photomultiplier 5, and thus the total reflectivity (R) was calculated. It should be noted that, regarding the total reflected light, the entire amount of light including light reflected on the surface of the fabric and light that has been transmitted to the back surface of the fabric, and is reflected by the alumina plate and emitted from the front surface of the fabric again is taken into consideration.

Figure 8:
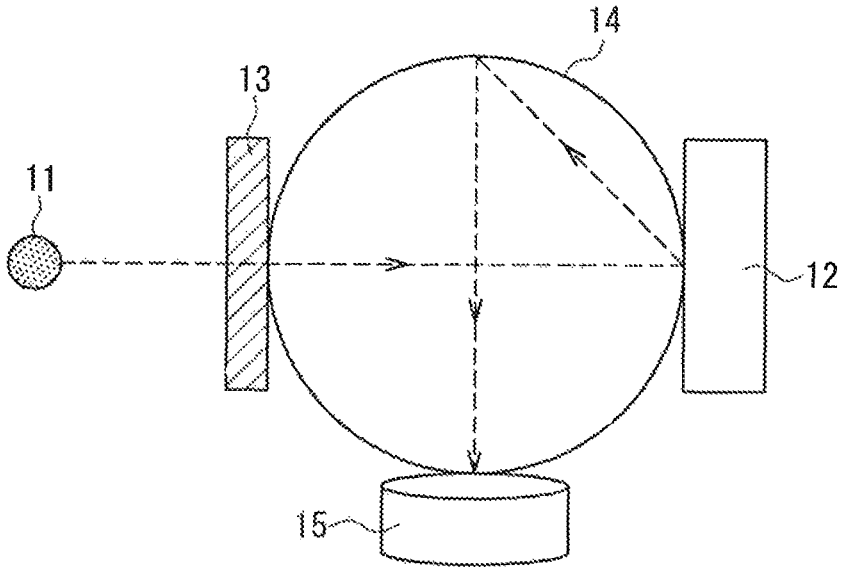
FIG. 8 is a schematic explanatory diagram illustrating a measurement method of measuring a transmittance of a fabric with respect to incident light.

(2) Next, a spectrophotometer (model "U-4100" manufactured by Hitachi High-Technologies Corporation) was used to measure the transmittance of the fabric. Specifically, as shown in FIG. 8, light emitted by a xenon lamp 11 was dispersed, the front surface of a fabric 13 that was directly arranged at an entrance on a light-irradiation side of an integrating sphere 14 was irradiated with the dispersed light, transmitted light was integrated using the integrating sphere 14, the light intensity was measured using a photomultiplier 15, and thus the transmittance (t1) was calculated. In FIG. 8, a reference numeral 12 indicates an alumina plate.

(3) The total reflectivity (R) and the transmittance (t1) were used to calculate absorptivity (a1) based on the following simultaneous equations. It should be noted that r1 means the reflectivity of the fabric in the following simultaneous equations.

Equation 1

$$1 = r_1 + t_1 + a_1 \quad (1)$$

$$R = r_1 + \frac{t_1^2}{1 - r_1} \quad (2)$$

(4) In the obtained graph illustrating the total reflectivity in which the horizontal axis indicates the wavelength of the incident light and the vertical axis indicates the total reflectivity, a ratio of the area of a portion under the curve of the graph illustrating the total reflectivity with respect to the area of a portion surrounded by the wavelength of 750 to 2500 nm and the reflectivity of 0 to 100% was determined and taken as the average total reflectivity with respect to incident light with a wavelength of 750 to 2500 nm.

(5) In the obtained graph illustrating the absorptivity in which the horizontal axis indicates the wavelength of the incident light and the vertical axis indicates the absorptivity, a ratio of the area of a portion under the curve of the graph illustrating the absorptivity with respect to the area of a portion surrounded by the wavelength of 750 to 2500 nm and the absorptivity of 0 to 100% was determined and taken as the average absorptivity with respect to incident light with a wavelength of 750 to 2500 nm.

TABLE 1

| Fabric No. | Fabric composition | | | | Content of infrared absorber (%) | Acrylic fiber No. | Additive and blend amount | | Basis weight (oz/yd$^2$) | ATPV (cal/cm$^2$) | Specific ATPV (cal/cm$^2$)/(oz/yd$^2$) | ATPC | Thickness (mm) |
|---|---|---|---|---|---|---|---|---|---|---|---|---|---|
| Ex. A1 | Arc1 50% | | PA 25% | MA 25% | 8.3 | Arc1 | SN100P 10 parts | Patx-M 10 parts | 6.9 | 9.4 | 1.36 | 3.39 | 0.94 |
| Ex. A2 | Arc2 25% | PBB 25% | PA 25% | MA 25% | 4.2 | Arc2 | SN100P 20 parts | | 7.3 | 9.6 | 1.32 | 3.42 | 0.96 |
| Ex. A3 | Arc2 12.5% | PBB 37.5% | PA 25% | MA 25% | 2.1 | Arc2 | SN100P 20 parts | | 7.3 | 9.3 | 1.27 | 3.42 | 0.97 |
| Ex. A4 | Arc3 50% | | PA 25% | MA 25% | 2.4 | Arc3 | SN100P 5 parts | | 7.5 | 8.3 | 1.11 | 2.57 | 0.93 |
| Ex. A5 | Arc4 50% | | PA 25% | MA 25% | 2.4 | Arc4 | ET521W 5 parts | | 7.4 | 9.5 | 1.28 | 3.14 | 0.95 |
| Ex. A6 | Arc5 50% | | PA 25% | MA 25% | 2.4 | Arc5 | SN100D 5 parts | | 7.4 | 8.7 | 1.18 | 2.79 | 0.95 |
| Ex. A7 | Arc3 10% | PBB 40% | PA 25% | MA 25% | 0.5 | Arc3 | SN100P 5 parts | | 7.4 | 7.4 | 1.00 | 2.23 | 0.96 |
| Ex. A8 | Arc6 25% | | PA 25% | MA 25% | 4.5 | Arc6 | SN100P 10 parts | | 7.5 | 10 | 1.33 | 3.30 | 0.93 |
| Ex. A9 | Arc6 25% | PBB 25% | PA 25% | MA 25% | 2.3 | Arc6 | SN100P 10 parts | | 7.6 | 12 | 1.58 | 4.09 | 0.94 |
| Ex. A10 | Arc7 50% | | PA 25% | MA 25% | 2.2 | Arc7 | SN100P 5 parts | R-22L 10 parts | 7.6 | 12.2 | 1.61 | 4.18 | 0.95 |
| Ex. A11 | Arc8 8% | ProC 42% | PA 25% | MA 25% | 1.3 | Arc8 | ET521W 20 parts | | 7.8 | 8.7 | 1.12 | 7.35 | 0.96 |
| Ex. A12 | Arc9 8% | ProC 42% | PA 25% | MA 25% | 1.3 | Arc9 | ET521W 20 parts | | 7.4 | 8.7 | 1.18 | 8.56 | 0.95 |
| Ex. A13 | | ProC 50% | PA 50% | | 2 | | | Patx-M 10 parts | 8.1 | 12 | 1.48 | | 0.61 |
| Ex. A14 | | ProM 60% | Cot 40% | | 1.3 | | | Patx-M 26 parts | 8.2 | 12 | 1.46 | | 0.55 |
| Ex. A15 | | ProC 60% | Cot 40% | | 0.66 | | | Patx-M 26 parts | 8.2 | 9.6 | 1.17 | | 0.56 |
| Ex. A16 | | ProC 60% | Cot 40% | | 1.4 | | | Patx-M 26 parts | 8.2 | 9.8 | 1.20 | | 0.57 |
| Ex. A17 | | ProC 60% | Cot 40% | | 2.1 | | | Patx-M 26 parts | 8.4 | 10 | 1.19 | | 0.57 |
| Comp. Ex. A1 | | Arc101 50% | PA 25% | MA 25% | 0 | Arc101 | | Patx-M 10 parts | 7.6 | 6.4 | 0.84 | 1.72 | 0.99 |
| Comp. Ex. A2 | | Arc 102 50% | PA 25% | MA 25% | 0 | Arc102 | R-22L 10 parts | Patx-M 10 parts | 8.0 | 7.6 | 0.95 | 2.06 | 0.96 |
| Comp. Ex. A3 | | Arc103 50% | PA 25% | MA 25% | 0 | Arc103 | STE-60A-LP 10 parts | Patx-M 10 parts | 7.8 | 7.2 | 0.92 | 1.98 | 0.97 |

TABLE 1-continued

| Fabric No. | Fabric composition | | | Content of infrared absorber (%) | Acrylic fiber No. | Additive and blend amount | | Basis weight (oz/yd$^2$) | ATPV (cal/cm$^2$) | Specific ATPV (cal/cm$^2$)/(oz/yd$^2$) | ATPC | Thickness (mm) |
|---|---|---|---|---|---|---|---|---|---|---|---|---|
| Comp. Ex. A4 | Arc104 50% | PA 25% | MA 25% | 0 | Arc104 | FINEX-25-LPT 10 parts | Patx-M 10 parts | 6.9 | 6.2 | 0.90 | 1.90 | 0.93 |
| Comp. Ex. A5 | Arc105 50% | PA 25% | MA 25% | 0 | Arc105 | SB-UVA6164 10 parts | Patx-M 10 parts | 7.7 | 6.1 | 0.79 | 1.56 | 0.94 |
| Comp. Ex. A6 | Arc106 50% | PA 25% | MA 25% | 0 | Arc106 | SB-UVA6577 10 parts | Patx-M 10 parts | 7.8 | 6 | 0.77 | 1.48 | 0.96 |
| Comp. Ex. A7 | PBB 50% | PA 25% | MA 25% | 0 | PBB | | | 7.7 | 5.9 | 0.77 | 1.47 | 1.00 |
| Ref. Ex. 1 | | PA 50% | MA 50% | | | | | 8.9 | 8.2 | 0.92 | | 0.66 |
| Ref. Ex. 2 | ProC 50% | PA 25% | MA 25% | | | Patx-M 10 parts | | 8.7 | 11 | 1.26 | | 0.63 |
| Ref. Ex. 3 | ProC 50% | PA 25% | MA 25% | | | Patx-M 10 parts | | 7.6 | 6.5 | 0.86 | | 0.51 |

TABLE 2

| | Ex. | | | | | | | | |
|---|---|---|---|---|---|---|---|---|---|
| | A1 | A2 | A3 | A4 | A5 | A6 | A7 | A8 | A9 |
| Average total reflectivity (%) | 19.9 | 22.4 | 31.1 | 28.2 | 28.3 | 37.4 | 36.2 | 27.9 | 29.1 |
| | Ex. | | | | | | | | |
| | A10 | A11 | A12 | A13 | A14 | A15 | A16 | A17 | |
| Average total reflectivity (%) | 34.5 | 46.0 | 47.0 | 29.2 | 40.0 | 37.8 | 35.3 | 30.0 | |

TABLE 3

| | Comp. Ex. | | | | | | |
|---|---|---|---|---|---|---|---|
| | A1 | A2 | A3 | A4 | A5 | A6 | A7 |
| Average total reflectivity (%) | 71.4 | 70.3 | 70.7 | 74.4 | 74.2 | 74.8 | 74.0 |

TABLE 4

| | Ex. A4 | Ex. A8 | Comp. Ex. A7 |
|---|---|---|---|
| Average absorptivity (%) | 67.7 | 75.1 | 22.5 |

It was found from the data shown in Table 1 above that the acrylic fibers of the examples including the infrared absorber had an ATPC of 2.1 or more, which was higher than the ATPCs of the acrylic fibers of the comparative examples including no infrared absorber, and had a favorable arc resistance. The higher the content of the infrared absorber was, the more favorable the arc resistance of the acrylic fiber was. When the infrared absorber was the antimony-doped tin oxide coating on titanium dioxide, the arc resistance was more favorable compared with the case where the infrared absorber was the antimony-doped tin oxide. Also, when the antimony-doped tin oxide serving as the infrared absorber and the titanium oxide serving as the ultraviolet absorber were used in combination, the arc resistance was more favorable compared with the case where only the antimony-doped tin oxide serving as the infrared absorber was used. The fabrics of the examples had a specific ATPV of 1 (cal/cm$^2$)/(oz/yd$^2$) or more, and had a favorable arc resistance.

As is clear from Tables 2 and 3 and FIGS. 1, 2, 3, and 4, regarding the fabric of Example A1 (FIG. 1A), the fabric of Example A4 (FIG. 1B), the fabric of Example A5 (FIG. 1C), the fabric of Example A7 (FIG. 1D), the fabric of Example A8 (FIG. 1E), the fabric of Example A10 (FIG. 1F), the fabric of Example A12 (FIG. 1G), the fabric of Example A2 (FIG. 3A), the fabric of Example A3 (FIG. 3B), the fabric of Example A6 (FIG. 3C), the fabric of Example A9 (FIG. 3D), the fabric of Example A11 (FIG. 3E), the fabric of Example A13 (FIG. 3F), the fabric of Example A14 (FIG. 4A), the fabric of Example A15 (FIG. 4B), the fabric of Example A16 (FIG. 4C), and the fabric of Example A17 (FIG. 4D), the average total reflectivity with respect to incident light with a wavelength of 750 to 2500 nm was 50% or less, and the infrared ray absorbability was high. In particular, regarding the fabric of Example A1 (FIG. 1A), the fabric of Example A4 (FIG. 1B), the fabric of Example A5 (FIG. 1C), the fabric of Example A8 (FIG. 1E), and the fabric of Example A10 (FIG. 1F), the total reflectivity in the wavelength range of 2000 nm or longer was 20% or less. On the other hand, regarding the fabric of Comparative Example A1 (FIG. 2A), the fabric of Comparative Example A2 (FIG. 2B), the fabric of Comparative Example A3 (FIG. 2C), the fabric of Comparative Example A4 (FIG. 2D), the fabric of Comparative Example A5 (FIG. 2E), the fabric of Comparative Example A6 (FIG. 2F), and the fabric of Comparative Example A7 (FIG. 2G), the average total reflectivity with respect to incident light with a wavelength of 750 to 2500 nm exceeded 50%, and the infrared ray absorbability was low. It is presumed that regarding the fabrics of the examples, the arc resistance was improved due to the high infrared ray absorbability. It was also found from the comparison of FIG. 5A (Example A4), FIG. 5B (Example A8), and FIG. 5C (Comparative Example A7) and the results shown in Tables 4 and 1 that as the content of the infrared absorber was increased, the absorptivity was improved (the infrared ray absorbability was improved), and the arc resistance of the fabric was improved. High absorptivity means the high infrared ray absorbability. Regarding Example A4, Example A8, and Comparative Example A7, the average total reflectivity and the average absorptivity with respect to incident light with a wavelength of 750 to 2500 nm indicated the inverse correlation, namely a relationship in which the lower the average total reflectivity was, the higher the average absorptivity was, and thus the infrared ray absorbability can be evaluated using the average total reflectivity.

Example B1

Commercially available cotton (middle-fiber cotton) was used as a natural cellulose fiber and was spun through ring spinning. The obtained spun yarn was a spun yarn of English cotton count No. 20. The spun yarn was used to manufacture a plain-knitted fabric that included cotton in an amount of 100 wt % and had a basis weight shown in Table 5 below using an ordinary manufacturing method with a flat-knitting machine.

Flame-Retardant Treatment

The obtained fabric (knitted fabric) was flame-retarded through Pyrovatex finish using a phosphorus-based compound. First, a flame-retardant treatment solution (treatment agent) including a phosphorus-based compound ("Pyrovatex CP NEW" manufactured by Huntsman; N-methyloldimethylphosphonopropionic acid amide) in an amount of 400 g/L, a cross-linking agent ("BECKAMIINE J-101" manufactured by DIC Corporation; hexamethoxymethylol-type melamine) in an amount of 60 g/L, a softening agent ("ULTRATEX FSA NEW" manufactured by Huntsman; silicone-based softening agent) in an amount of 30 g/L, 85% phosphoric acid in an amount of 20.7 g/L, and a penetrating agent ("INVADINE PBN" manufactured by Huntsman) in an amount of 5 ml/L was prepared. After the flame-retardant treatment solution had sufficiently infiltrated into the fabric, the flame-retardant treatment solution was squeezed out of the fabric using a hydroextractor such that the squeeze ratio was 80±2%, and then the fabric was dried at 110° C. for 5 minutes and subjected to heat treatment at 150° C. for 5 minutes. Thereafter, the fabric was washed with an aqueous solution of sodium carbonate and water, and neutralized with an aqueous solution of hydrogen peroxide. The fabric was washed with water and dewatered, and then dried at 60° C. for 30 minutes using a tumbler dryer. Thus, a flame-retardant fabric was obtained. The obtained flame-retardant fabric included Pyrovatex as a solid in an amount of 20 parts by weight with respect to 100 parts by weight of the fabric.

Attachment of Infrared Absorber

The obtained flame-retardant fabric was impregnated with an antimony-doped tin oxide dispersion ("SN-100D" manufactured by Ishihara Sangyo Kaisha, Ltd., which is an aqueous dispersion obtained by adding antimony-doped tin oxide in an amount of 30 wt % to water and dispersing it; having a particle diameter of 0.085 to 0.120 μm, which was measured using a laser diffraction method) and then dried, and thus the antimony-doped tin oxide in an amount of 0.42 parts by weight with respect to 100 parts by weight of the flame-retardant fabric was attached to the flame-retardant fabric.

Example B2

A flame-retardant fabric was obtained in the same manner as in Example B1. The obtained flame-retardant fabric was impregnated with an antimony-doped tin oxide dispersion ("SN-100D" manufactured by Ishihara Sangyo Kaisha, Ltd., which is an aqueous dispersion obtained by adding antimony-doped tin oxide in an amount of 30 wt % to water and dispersing it; having a particle diameter of 0.085 to 0.120 μm, which was measured using a laser diffraction method) and then dried, and thus the antimony-doped tin oxide in an amount of 0.89 parts by weight with respect to 100 parts by weight of the flame-retardant fabric was attached to the flame-retardant fabric.

Example B3

Commercially available cotton (middle-fiber cotton) was used as a natural cellulose fiber and was spun through ring spinning. The obtained spun yarn was a spun yarn of English cotton count No. 20. The spun yarn was used to manufacture a twill woven fabric having a basis weight of 7.4 oz/yd$^2$ using an ordinary weaving method. Next, a flame-retardant fabric was obtained through the same flame-retardant treatment as that performed in Example B1. The obtained flame-retardant fabric was impregnated with an antimony-doped tin oxide dispersion ("SN-100D" manufactured by Ishihara Sangyo Kaisha, Ltd., which is an aqueous dispersion obtained by adding antimony-doped tin oxide in an amount of 30 wt % to water and dispersing it; having a particle diameter of 0.085 to 0.120 μm, which was measured using a laser diffraction method) and then dried, and thus the antimony-doped tin oxide in an amount of 1.4 parts by weight with respect to 100 parts by weight of the flame-retardant fabric was attached to the flame-retardant fabric.

Example B4

A flame-retardant fabric was obtained in the same manner as in Example B3. The obtained fabric was impregnated with a methanol dispersion of antimony-doped zinc oxide ("CELNAX CX-Z610M-F2" manufactured by Nissan Chemical Industries, Ltd., which is a methanol dispersion obtained by adding antimony-doped zinc oxide in an amount of 60 wt % to methanol and dispersing it; having an average particle diameter (D50) of 15 nm, which was measured using a laser diffraction method) and then dried, and thus the antimony-doped zinc oxide in an amount of 0.62 parts by weight with respect to 100 parts by weight of the flame-retardant fabric was attached to the flame-retardant fabric.

Example B5

A fabric was manufactured in the same manner as in Example B4, except that antimony-doped zinc oxide in an amount of 1.21 parts by weight with respect to 100 parts by weight of the flame-retardant fabric was attached to the flame-retardant fabric.

Example B6

A fabric was manufactured in the same manner as in Example B4, except that antimony-doped zinc oxide in an amount of 1.86 parts by weight with respect to 100 parts by weight of the flame-retardant fabric was attached to the flame-retardant fabric.

Comparative Example B1

Commercially available cotton (middle-fiber cotton) was used as a natural cellulose fiber and was spun through ring spinning. The obtained spun yarn was a spun yarn of English cotton count No. 20. The spun yarn was used to manufacture a plain-knitted fabric that included cotton in an amount of 100 wt % and had a basis weight shown in Table 5 below using an ordinary manufacturing method with a flat-knitting machine. The obtained fabric was impregnated with an antimony-doped tin oxide dispersion ("SN-100D" manufactured by Ishihara Sangyo Kaisha, Ltd., which is an aqueous dispersion obtained by adding antimony-doped tin oxide in an amount of 30 wt % to water and dispersing it; having a particle diameter of 0.085 to 0.120 μm, which was measured using a laser diffraction method) and then dried, and thus the antimony-doped tin oxide in an amount of 2.3 parts by weight with respect to 100 parts by weight of the fabric was attached to the fabric. Thus, a fabric having a basis weight shown in Table 5 below was obtained.

The arc resistance of each of the fabrics obtained in Examples B1 to B6 and Comparative Examples B1 was evaluated through the above-described arc testing. Table 5 below shows the results. The total reflectivity of each of the fabrics obtained in Examples B1 to B6 and Comparative Examples B1 was measured as described above. FIG. 6 and Table 5 below show the results. In Table 5 below, the average total reflectivity refers to an average total reflectivity with respect to incident light with a wavelength of 750 to 2500 nm. FIGS. 6A to 6G show the graphs of total reflectivity of the fabrics of Examples B1 to B6 and Comparative Example B1, respectively. The thickness of each of the fabrics obtained in Examples B1 to B6 and Comparative Examples B1 were measured as described above. Table 5 below shows the results.

TABLE 5

| | Ex. B1 | Ex. B2 | Ex. B3 | Ex. B4 | Ex. B5 | Ex. B6 | Comp. Ex. B1 |
|---|---|---|---|---|---|---|---|
| Basis weight (oz/yd$^2$) | 7.0 | 7.0 | 7.4 | 7.4 | 7.5 | 7.5 | 6.1 |
| ATPV (cal/cm$^2$) | 9.0 | 10.0 | 8.8 | 8 | 8.8 | 8 | less than 6.0 (with hole) |
| Specific ATPV (cal/cm$^2$)/(oz/yd$^2$) | 1.29 | 1.43 | 1.19 | 1.08 | 1.17 | 1.07 | less than 0.98 |
| Thickness (mm) | 0.54 | 0.54 | 0.56 | 0.53 | 0.50 | 0.51 | 0.62 |
| Average total reflectivity (%) | 56.8 | 52.5 | 37.9 | 42.4 | 35.3 | 30.2 | 40.9 |

As is clear from Table 5 above, the fabrics of Examples B1 to B6, which included the natural cellulose fiber (cotton), the flame retardant, and the infrared absorber and in which the average total reflectivity with respect to incident light with a wavelength of 750 to 2500 nm was 60% or less, had a specific ATPV of 1 (cal/cm$^2$)/(oz/yd$^2$) or more, and had a favorable arc resistance. On the other hand, the fabric of Comparative Example B1, which included the natural cellulose fiber and the infrared absorber but no flame retardant, had a specific ATPV of less than 0.98 (cal/cm$^2$)/(oz/yd$^2$) and was provided with a hole, and thus had poor arc resistance.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. An arc resistant acrylic fiber comprising:

an acrylic polymer comprising acrylonitrile in an amount of 40 to 70 wt %, a halogen-containing vinyl-based monomer in an amount of 30 to 57 wt %, and a sulfonic group-containing monomer in an amount of 0 to 3 wt %, with respect to a total weight of the acrylic polymer, and an infrared absorber in an amount of 1 wt % to 30 wt % with respect to a total weight of the acrylic polymer, wherein the infrared absorber is a tin oxide based compound, and wherein the infrared absorber is dispersed throughout the interior of the fiber.

2. The arc resistant acrylic fiber according to claim 1, wherein the tin oxide-based compound is one or more selected from the group consisting of antimony-doped tin oxide, indium-tin oxide, niobium-doped tin oxide, phosphorus-doped tin oxide, fluorine-doped tin oxide, and antimony-doped tin oxide coating on titanium dioxide.

3. The arc resistant acrylic fiber according to claim 1, further comprising an ultraviolet absorber.

4. The arc resistant acrylic fiber according to claim 3, wherein the ultraviolet absorber is titanium oxide.

5. The arc resistant acrylic fiber according to claim 1, wherein the acrylic polymer comprises the acrylonitrile in an amount of 45 to 65 wt % and the halogen-containing vinyl-based monomer in an amount of 35 to 52 wt %, with respect to the total weight of the acrylic polymer.

6. A fabric for arc-protective clothing, comprising the arc resistant acrylic fiber according to claim 1, wherein the fabric comprises 0.5 wt % or more of the infrared absorber.

7. The fabric for arc-protective clothing according to claim 6, further comprising an aramid fiber.

8. The fabric for arc-protective clothing according to claim 6, further comprising a cellulosic fiber.

9. The fabric for arc-protective clothing according to claim 6, wherein, when the fabric for arc-protective clothing has a basis weight of 8 oz/yd$^2$ or less, an ATPV value measured based on ASTM F1959/F1959M-12 is 8 cal/cm$^2$ or more.

10. The fabric for arc-protective clothing according to claim 6, wherein an average total reflectivity of any of the front surface and the back surface of the fabric is 50% or less with respect to incident light with a wavelength of 750 to 2500 nm and the difference in the average total reflectivity with respect to incident light with a wavelength of 750 to 2500 nm between the front surface and the back surface is 5% or less.

11. An arc-protective clothing comprising the fabric for arc-protective clothing according to claim 6.

12. A fabric for arc-protective clothing, comprising:

a cellulosic fiber, an infrared absorber, and a flame retardant, wherein an average total reflectivity of any of the front surface and the back surface of the fabric is 60% or less with respect to incident light with a wavelength of 750 to 2500 nm and the difference in the average total reflectivity with respect to incident light with a wavelength of 750 to 2500 nm between the front surface and the back surface is 5% or less, and the infrared absorber is a tin oxide based compound.

13. The fabric for arc-protective clothing according to claim 12, wherein, when the fabric for arc-protective clothing has a basis weight of 8 oz/yd$^2$ or less, an ATPV value measured based on ASTM F1959/F1959M-12 is 8 cal/cm$^2$ or more.

14. An arc-protective clothing comprising the fabric for arc-protective clothing according to claim 12.

* * * * *